US009904188B2

(12) United States Patent
Tanaka et al.

(10) Patent No.: US 9,904,188 B2
(45) **Date of Patent: *Feb. 27, 2018**

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Daisuke Tanaka, Yokohama (JP); Kazumichi Sugiyama, Numazu (JP); Takeshi Murakami, Numazu (JP); Daisuke Kawaguchi, Toride (JP); Wataru Kitamura, Abiko (JP); Mai Murakami, Kashiwa (JP); Kenichi Ikari, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/107,445

(22) PCT Filed: Dec. 19, 2014

(86) PCT No.: PCT/JP2014/084736

§ 371 (c)(1),
(2) Date: Jun. 22, 2016

(87) PCT Pub. No.: WO2015/099191

PCT Pub. Date: Jul. 2, 2015

(65) Prior Publication Data

US 2016/0320737 A1 Nov. 3, 2016

(30) Foreign Application Priority Data

Dec. 26, 2013 (JP) ..... 2013-269674
Dec. 5, 2014 (JP) ..... 2014-247336

(51) Int. Cl.
*G03G 5/14* (2006.01)
*G03G 15/00* (2006.01)

(52) U.S. Cl.
CPC ..... *G03G 5/144* (2013.01); *G03G 15/751* (2013.01)

(58) Field of Classification Search
CPC ..... G03G 5/144
See application file for complete search history.

(56) References Cited

U.S. PATENT DOCUMENTS 5,641,599 A * 6/1997 Markovics ..... G03G 5/142 430/58.25
9,360,779 B2 * 6/2016 Ikari ..... G03G 5/14
(Continued)

FOREIGN PATENT DOCUMENTS

JP H02167557 A 6/1990
JP H02256060 A 10/1990
(Continued)

*Primary Examiner* — Christopher D Rodee
(74) *Attorney, Agent, or Firm* — Canon U.S.A. Inc. IP Division

(57) ABSTRACT

An undercoat layer of an electrophotographic photosensitive member contains a binder resin and conductive particles. Each of the conductive particles has a core particle coated with tin oxide doped with aluminum.

12 Claims, 1 Drawing Sheet

(56) References Cited

U.S. PATENT DOCUMENTS

| | | | | |
|---|---|---|---|---|
| 2006/0234146 | A1* | 10/2006 | Miki | G03G 5/104 430/63 |
| 2007/0026332 | A1* | 2/2007 | Ferrar | G03G 5/102 430/64 |
| 2012/0114375 | A1* | 5/2012 | Fujii | G03G 5/144 399/111 |
| 2013/0316283 | A1* | 11/2013 | Fujii | G03G 5/10 430/133 |
| 2013/0323632 | A1* | 12/2013 | Fujii | G03G 5/104 430/56 |
| 2014/0065529 | A1* | 3/2014 | Fujii | G03G 5/104 430/56 |

FOREIGN PATENT DOCUMENTS

| | | | |
|---|---|---|---|
| JP | H06208238 | A | 7/1994 |
| JP | H07295270 | A | 11/1995 |
| JP | 2003186220 | A | 7/2003 |
| JP | 2003300727 | A | 10/2003 |
| JP | 2005247939 | A | 9/2005 |
| JP | 4105861 | B2 | 6/2008 |
| JP | 4301589 | B2 | 7/2009 |
| JP | 2011506700 | A | 3/2011 |
| JP | 2011112931 | A | 6/2011 |
| JP | 2012018370 | A | 1/2012 |
| JP | 2012018371 | A | 1/2012 |

* cited by examiner

ELECTROPHOTOGRAPHIC PHOTOSENSITIVE MEMBER, PROCESS CARTRIDGE, AND ELECTROPHOTOGRAPHIC APPARATUS

Cross-Reference to Related Applications

This application is a National Stage filing of International Application No. PCT/JP2014/0084736 filed Dec. 19, 2014, which claims the benefit of Japanese Patent Application No. 2013-269674, filed Dec. 26, 2013 and Japanese Patent Application No. 2014-247336, filed Dec. 5, 2014, the disclosures of each of which are hereby incorporated by reference herein in their entirety.

TECHNICAL FIELD

The present invention relates to an electrophotographic photosensitive member as well as an electrophotographic apparatus and a process cartridge having an electrophotographic photosensitive member.

BACKGROUND ART

An electrophotographic photosensitive member having an undercoat layer and a photosensitive layer formed in this order on a support has been used in electrophotographic apparatus.

In some known technologies, the undercoat layer contains metal oxide particles for improved conductivity. PTL 1 describes a technology in which the undercoat layer contains titanium oxide particles coated with phosphorus- or tungsten-doped tin oxide. PTL 2 describes a technology in which the undercoat layer contains aluminum-doped zinc oxide particles. PTL 3 describes a technology in which the undercoat layer contains titanium oxide particles coated with oxygen-deficient tin oxide. PTL 4 discloses a technology in which the undercoat layer contains barium sulfate particles coated with titanium oxide. These known electrophotographic photosensitive members, in which the undercoat layer contains metal oxide particles, satisfy the current image quality requirements.

In recent years, electrophotographic apparatus have been getting faster and faster (in terms of process speed or cycle speed) and it has been demanded that an electrophotographic photosensitive member perform better in repeated use.

The inventors found through research that the electrophotographic photosensitive members described in the above literature, having an undercoat layer that contains metal oxide particles, become more likely to have the following problems with increasing process speed of the electrophotographic apparatus. More specifically, they have room for improvement because repeated image formation with them under low-temperature and low-humidity conditions can cause many of output images to have streaks caused by charge (hereinafter, charge streaks). Charge streaks are streak-like image defects extending perpendicular to the longitudinal direction of charge of a surface-charged electrophotographic photosensitive member, and they occur as a result of the electrophotographic photosensitive member experiencing a decrease in the uniformity of its surface potential (charge nonuniformity). Charge streaks are particularly common when a half-tone image is output.

CITATION LIST

Patent Literature

PTL 1 Japanese Patent Laid-Open No. 2012-18371
PTL 2 Japanese Patent Laid-Open No. 2012-18370

PTL 3 Japanese Patent Laid-Open No. 6-208238
PTL 4 Japanese Patent Laid-Open No. 7-295270
PTL 5 PCT Japanese Translation Patent Publication No. 2011-506700
PTL 6 Japanese Patent No. 4105861
PTL 7 Japanese Patent No. 4301589

SUMMARY OF INVENTION

An aspect of the invention provides an electrophotographic photosensitive member that allows the user to perform repeated image formation under low-temperature and low-humidity conditions with reduced charge streaks. Some other aspects of the invention provide a process cartridge and an electrophotographic apparatus having such an electrophotographic photosensitive member.

An aspect of the invention is an electrophotographic photosensitive member. The electrophotographic photosensitive member has a support, an undercoat layer on the support, and a photosensitive layer on the undercoat layer. The undercoat layer contains a binder resin and conductive particles each having a core particle coated with tin oxide doped with aluminum.

Another aspect of the invention is a process cartridge. The process cartridge has an electrophotographic photosensitive member described above and at least one unit selected from the group consisting of a charging unit, a development unit, and a cleaning unit and integrally holds the electrophotographic photosensitive member and the unit. The process cartridge is attachable to and detachable from a main body of an electrophotographic apparatus.

Another aspect of the invention is an electrophotographic apparatus. The electrophotographic apparatus has an electrophotographic photosensitive member described above, a charging unit, an exposure unit, a development unit, and a transfer unit.

According to an aspect of the invention, an electrophotographic photosensitive member can be provided that allows the user to perform repeated image formation under low-temperature and low-humidity conditions with reduced charge streaks. According to some other aspects of the invention, a process cartridge and an electrophotographic apparatus can be provided having such an electrophotographic photosensitive member.

Further features of the present invention will become apparent from the following description of exemplary embodiments with reference to the attached drawings.

DESCRIPTION OF EMBODIMENTS

An electrophotographic photosensitive member according to an embodiment of the invention has a support, an undercoat layer on the support, and a photosensitive layer on the undercoat layer. The photosensitive layer can be a monolayer photosensitive layer, which contains a charge generating substance and a charge transporting substance in a single layer, or a multilayer photosensitive layer, which has a charge generating layer containing a charge generating substance and a charge transporting layer containing an electron transporting substance. Preferably, the photosensitive layer is a multilayer photosensitive layer.

Figure 2A:
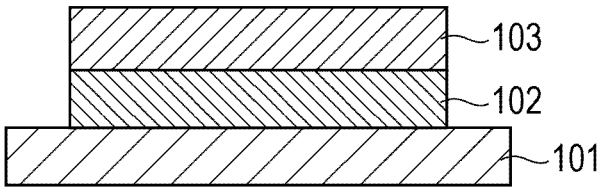
FIGS. 2A and 2B are diagrams each illustrating an example of a layer structure of an electrophotographic photosensitive member.
Figure 2B:
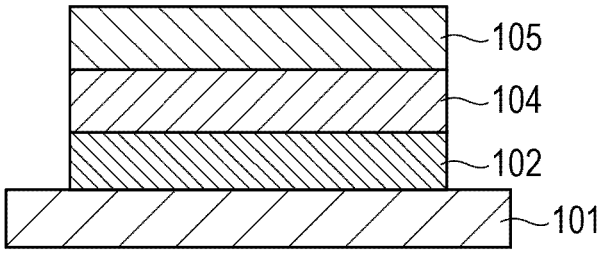

FIGS. 2A and 2B each illustrate an example of a layer structure of an electrophotographic photosensitive member according to an embodiment of the invention. FIG. 2A includes a support 101, an undercoat layer 102, and a photosensitive layer 103. FIG. 2B includes a support 101, an undercoat layer 102, an intermediate layer 104, and a photosensitive layer 105.

In an embodiment of the invention, the undercoat layer of the electrophotographic photosensitive member contains a binder resin and conductive particles each having a core particle coated with tin oxide ($SnO_2$) doped with aluminum. The conductive particles are composite particles each having a core particle coated with tin oxide ($SnO_2$) doped with aluminum. Conductive particles coated with tin oxide doped with aluminum (composite particles) can hereinafter be referred to as "aluminum-doped tin-oxide-coated particles."

The following is the inventors' thoughts on why the use of an electrophotographic photosensitive member according to an embodiment of the invention leads to reduced charge streaks in repeated image formation under low-temperature and low-humidity conditions, particularly at a high process speed.

With respect to the direction of the rotation of the electrophotographic photosensitive member, the near and other sides of the charging area (an area provided on the surface of the electrophotographic photosensitive member and configured to be electrified by a charging unit) are hereinafter referred to as the upper charging area and the lower charging area, respectively. Electric charge is first applied to the surface of the electrophotographic photosensitive member in the upper charging area, and then a smaller amount of charge is applied in the lower charging area. As a result, it is a common case that the surface of an electrophotographic photosensitive member has an adequate amount of charge in some areas but not in some other areas. This causes irregularities in electric potential on the surface of the electrophotographic photosensitive member (charge nonuniformity), and the potential irregularities lead to streak-like image defects appearing on output images, extending perpendicular to the radial direction of the surface of the electrophotographic photosensitive member (charge streaks).

A possible cause of charge streaks is dielectric polarization. Dielectric polarization is a phenomenon where a dielectric body placed in an electric field experiences charge polarization. A form of this dielectric polarization is orientation polarization, which results from the dipole moment in the molecules constituting the dielectric body turning in a different direction.

The following describes the relationship between orientation polarization and the surface potential of an electrophotographic photosensitive member in relation to the electric field changes that the electrophotographic photosensitive member undergoes when the surface of the electrophotographic photosensitive member is electrified.

Applying electric charge to the surface of an electrophotographic photosensitive member in the upper charging area generates an electric field (hereinafter referred to as "the external electric field"). The external electric field makes the dipole moments in the electrophotographic photosensitive member gradually polarize (orientation polarization). The vector sum of the polarized dipole moments represents an electric field generated in the electrophotographic photosensitive member through polarization (hereinafter referred to as "the internal electric field"). The internal electric field grows with the progress of polarization over time. The vector of the internal electric field faces in the opposite direction with respect to the external electric field.

If the amount of charge on the surface of an electrophotographic photosensitive member is constant, then the external electric field formed by the charge is constant. The internal electric field, however, grows inversely with respect to the external electric field with the progress of orientation polarization. The overall intensity of the electric field experienced by the electrophotographic photosensitive member, which is the sum of the external electric field and the internal electric field, should gradually decrease with the progress of polarization.

A potential difference should be proportional to the electric field during the progress of orientation polarization. Thus the overall intensity of the electric field decreasing with the progress of orientation polarization lowers the surface potential of the electrophotographic photosensitive member.

A measure used to describe the progress of orientation polarization is dielectric loss tan δ. Dielectric loss, which is a heat energy loss due to the progress of orientation polarization in an alternating electric field, serves as a measure of the time dependence of orientation polarization. A high dielectric loss tan δ at a given frequency means that orientation polarization greatly progresses during the length of time corresponding to the frequency. A decrease that occurs in the surface potential of an electrophotographic photosensitive member with the progress of orientation polarization is influenced by how much the polarization progresses during the time between the start of the application of charge to the surface of the electrophotographic photosensitive member in the upper charging area and the application of charge to the surface of the electrophotographic photosensitive member in the lower charging area (approximately $1.0\times10^{-3}$ seconds in typical cases). If orientation polarization is not completed within this time frame, the surface potential of the electrophotographic photosensitive member should decrease because in such a case orientation polarization progresses before charge is applied to the surface of the electrophotographic photosensitive member in the lower charging area.

PTL 1 describes a technology in which this dielectric loss is regulated down to improve charge streaks (horizontal charge streaks). Reducing the dielectric loss makes orientation polarization progress faster, thereby advantageously controlling the decrease in surface potential in the lower charging area. This technology is therefore advantageous in that in the use of electrophotographic apparatus, charge streaks are reduced through electrification in the upper charging area and early completion of orientation polarization that prevents the potential from decreasing in the lower charging area.

The inventors found through research that the occurrence of charge streaks can be reduced when the process speed is increased. Increasing the process speed shortens the time given to the upper charging area. This necessitates the electrophotographic photosensitive member completing dielectric polarization in the upper charging area despite the shortened time frame, in order for the surface potential not to fall in the lower charging area. In some cases, furthermore, the charging component may be unable to complete discharging in the upper charging area as a result of discharge deterioration caused by repeated use. The inventors found that in such a case a decrease in surface potential in the lower charging area causes discharge, disadvantageously making charge streaks more likely to occur.

Certain aspects of the invention, in which an undercoat layer contains conductive particles each having a core particle coated with tin oxide doped with aluminum, enhance the dielectric polarization that occurs in an electrophotographic photosensitive member unlike known technologies, in which the dielectric polarization that occurs in an electrophotographic photosensitive member is reduced. Certain aspects of the invention should therefore improve charge streaks through a mechanism different from that through which the known technology described above improves charge streaks. The undercoat layer containing conductive particles according to certain aspects of the invention appears to experience an adequate fall in potential, compared with that in the known technology, from the potential at the end of the upper charging area to that in the lower charging area because of the intentionally enhanced dielectric polarization. The adequate fall in potential in an electrophotographic photosensitive member allows the electrophotographic photosensitive member to discharge a large amount of electricity in the lower charging area, thereby allowing for uniform discharge as a whole. This ensures that the electrophotographic photosensitive member is uniformly charged in the lower charging area, which presumably reduces the occurrence of charge streaks. Furthermore, the use of the conductive particles according to certain aspects of the invention ensures that the potential hardly falls after the lower charging area passes. This should also contribute to reducing the occurrence of charge streaks.

When the dopant is phosphorus, tungsten, or antimony, the powder resistivity tends to decrease with increasing amount of the dopant. It was found that when the dopant is aluminum, the powder resistivity rises with increasing amount of the dopant. The use of the aluminum-doped tin-oxide-coated titanium oxide particles in an undercoat layer resulted in a similar trend, suggesting enhanced dielectric polarization in the undercoat layer. The inventors believe that the resulting large fall in potential from the potential at the end of the upper charging area to that in the lower charging area improves horizontal charge streaks through the mechanism described above.

Undercoat Layer

The undercoat layer contains a binder resin and conductive particles each having a core particle coated with tin oxide doped with aluminum.

The volume resistivity of the undercoat layer can be $5.0\times10^{13}$ Ω·cm or less. Ensuring that the undercoat layer has a volume resistivity in this range will limit the amount of charge retained during image formation and thus lead to a reduced residual potential. The volume resistivity of the undercoat layer can be $5.0\times10^{10}$ Ω·cm or more, preferably $1.0\times10^{12}$ Ω·cm or more. Ensuring that the undercoat layer has a volume resistivity in this range will allow an adequate amount of charge to flow through the undercoat layer and thus reduce the occurrence of spots and fog during repeated image formation under high-temperature and high-humidity conditions.

Examples of core particles include an organic resin particle, an inorganic particle, and a metal oxide particle. Having a core particle, the aluminum-doped tin-oxide-coated particles are more effective than particles of tin oxide doped with aluminum in preventing black spots from occurring upon the application of a high-intensity electric field. An organic or metal oxide particle may be easily coated with tin oxide doped with aluminum when used as the core particle. When the core particle is a metal oxide particle, avoiding the use of tin oxide doped with aluminum as the metal oxide particle will ensure that composite particles are obtained.

The use of a zinc oxide particle, a titanium oxide particle, or a barium sulfate particle as the core particle will help to reduce charge streaks.

Some methods for producing tin oxide ($SnO_2$) doped with aluminum can be seen in PTL 5, 6, and 7.

Ensuring that the powder resistivity (specific powder resistivity) of the aluminum-doped tin-oxide-coated particles is $1.0\times10^{4}$ Ω·cm or more and $1.0\times10^{10}$ Ω·cm or less will help to adjust the volume resistivity of the undercoat layer in the range given above. Preferably, the powder resistivity of the aluminum-doped tin-oxide-coated particles is $1.0\times10^{4}$ Ω·cm or more and $1.0\times10^{9}$ Ω·cm or less. Forming the undercoat layer using a coating liquid (hereinafter a coating liquid for forming an undercoat layer) containing aluminum-doped tin-oxide-coated particles that have a powder resistivity in this range ensures that the volume resistivity of the undercoat layer is within the range given above. Ensuring that the powder resistivity of the aluminum-doped tin-oxide-coated particles falls within this range also leads to more effective prevention of charge streaks.

The content of tin oxide to the aluminum-doped tin-oxide-coated particles (coverage) can be 10% by mass or more and 60% by mass or less, preferably 15% by mass or more and 55% by mass or less.

Controlling the tin oxide coverage requires that a tin source for the formation of tin oxide be mixed during the production of the conductive particles. For example, tin oxide ($SnO_2$) formed from tin chloride ($SnCl_4$) as a tin source needs to be considered to control the tin oxide coverage. The tin oxide coverage is the content of tin oxide to the total mass of the conductive particles, determined disregarding the mass of aluminum as a dopant for tin oxide. Ensuring that the tin oxide coverage falls within the above range will help to control the powder resistivity of the conductive particles and contribute to uniform coating of the core particle with tin oxide.

The mass proportion of aluminum as a dopant for tin oxide to the mass of tin oxide alone (aluminum excluded) can be 0.1% by mass or more and 5% by mass or less, preferably 0.3% by mass or more and 5% by mass or less. Ensuring that the mass proportion of aluminum as a dopant for tin oxide falls within this range will lead to enhanced polarization in the conductive particles, thereby contributing to more effective prevention of charge streaks at high process speeds. When this mass proportion falls within the range specified above, the accumulation of residual potential can also be controlled.

The powder resistivity of the conductive particles is measured under normal temperature and humidity (23° C. and 50% RH) conditions. In certain embodiments of the invention, the measuring instrument is a Mitsubishi Chemical resistivity meter (trade name: Loresta GP). The composite particles of interest are made into a sample pellet for measurement through compression at a pressure of 500 $kg/cm^2$. The applied voltage is 100 V.

The undercoat layer can be formed by applying a coating liquid for forming an undercoat layer to form a coat and then drying and/or curing the resulting coat. The coating liquid for forming an undercoat layer can be obtained through the dispersion of the conductive particles and the binder resin in a solvent. Examples of dispersion methods include those based on the use of a paint shaker, a sand mill, a ball mill, or high-speed liquid jet dispersion equipment.

Examples of binder resins used in the undercoat layer include phenolic resin, polyurethane, polyamides, polyimides, polyamide-imides, polyvinyl acetal, epoxy resin, acrylic resin, melamine resin, and polyesters. Any one of such resins can be used alone, and it is also possible to use two or more.

In particular, the use of a curable resin will help to prevent migration (dissolution) into any other layer (e.g., the photosensitive layer), has positive impact on the dispersibility and dispersion stability of the composite particles, and may be advantageous in some other ways. Phenolic resin and polyurethane resin are curable resins that induce an adequately large dielectric relaxation when dispersed with the composite particles.

Examples of solvents used in the coating liquid for forming an undercoat layer include alcohols such as methanol, ethanol, isopropanol, and 1-methoxy-2-propanol, ketones such as acetone, methyl ethyl ketone, and cyclohexanone, ethers such as tetrahydrofuran, dioxane, ethylene glycol monomethyl ether, and propylene glycol monomethyl ether, esters such as methyl acetate and ethyl acetate, and aromatic hydrocarbons such as toluene and xylene.

In certain embodiments of the invention, ensuring that the aluminum-doped tin-oxide-coated particles (P) and the binder resin (B) are present in a mass ratio (P/B) of 1/1 or more and 4/1 or less will help to reduce cracks. Making this mass ratio fall within this range will also allow for easier control of the aforementioned volume resistivity of the undercoat layer.

The thickness of the undercoat layer can be 10 μm or more and 40 μm or less, preferably 10 μm or more and 30 μm or less.

In certain embodiments of the invention, the measuring instrument used to the thickness of the individual layers of the electrophotographic photosensitive member including the undercoat layer is Fischer Instruments FISCHERSCOPE mms.

The number-average particle diameter of the aluminum-doped tin-oxide-coated particles can be 0.03 μm or more and 0.60 μm or less, preferably 0.05 μm or more and 0.40 μm or less. Ensuring that the number-average particle diameter of the aluminum-doped tin-oxide-coated particles falls within this range will limit the occurrence of black spots by preventing focused injection of charge into the photosensitive layer, as well as further reducing cracks.

In an embodiment of the invention, the number-average particle diameter D (μm) of the aluminum-doped tin-oxide-coated particles was determined using a scanning electron microscope as follows. The particles of interest were observed under a Hitachi scanning electron microscope (trade name: S-4800), and the particle diameter of each of 100 of the aluminum-doped tin-oxide-coated particles was measured on the obtained image. The arithmetic mean was calculated and used as the number-average particle diameter D (μm). The particle diameter of each particle was defined as (a+b)/2, where "a" and b were the longest and shortest sides, respectively, of the primary particle.

The undercoat layer may further contain particles of tin oxide doped with aluminum (aluminum-doped tin oxide particles). This leads to more effective prevention of pattern fixation and elevated light-field potential. The volume ratio between the aluminum-doped tin oxide particles and the aluminum-doped tin-oxide-coated particles in the undercoat layer (aluminum-doped tin oxide particles/aluminum-doped tin-oxide-coated particles) can be 1/1000 or more and 250/1000 or less, preferably 1/1000 or more and 150/1000 or less. This is based on an idea that aluminum-doped tin oxide particles, which are not composite, help the aluminum-doped tin-oxide-coated particles to form conductive paths in the undercoat layer by filling any gaps where the conductive paths could be cut off.

The volume ratio between the aluminum-doped tin oxide particles and the aluminum-doped tin-oxide-coated particles can be determined through the isolation of the undercoat layer of the electrophotographic photosensitive member using FIB and a subsequent Slice & View observation with FIB-SEM.

The differences in contract in the FIB-SEM Slice & View image are used to identify the aluminum-doped tin oxide particles and the aluminum-doped tin-oxide-coated particles. Through this, the ratio between the volume of the aluminum-doped tin-oxide-coated particles and that of the aluminum-doped tin oxide particles can be determined. In an embodiment of the invention, the conditions for the Slice & View observation were as follows.

Processing of analytical samples: FIB

Processing and observation apparatus: SII/Zeiss NVision 40

Slice gap: 10 nm

Observation Conditions:

Acceleration voltage: 1.0 kV

Angle of inclination of samples: 54°

WD: 5 mm

Detector: A BSE detector

Aperture: 60 μm, high current

ABC: ON

Image resolution: 1.25 nm/pixel

The area of analysis is 2 μm long×2 μm wide, and the information from each cross-section is integrated to give the volume $V_1$ of aluminum-doped tin oxide particles and the volume $V_2$ of aluminum-doped tin-oxide-coated particles in a unit volume of 2 μm long×2 μm wide×2 μm thick ($V_T$=8 $\mu m^3$). The measurement is performed in an environment at a temperature of 23° C. and a pressure of $1\times10^{-4}$ Pa. The processing and observation apparatus may be FEI Strata 400S (angle of inclination of samples: 52°) instead. Sampling is performed ten times in a similar way, and the obtained ten samples are subjected to measurement. The mean of the volume $V_1$ of aluminum-doped tin oxide particles per 8 $\mu m^3$ at a total of ten points divided by $V_T$ (8 $\mu m^3$) was defined as the volume of aluminum-doped tin oxide particles in the undercoat layer of the electrophotographic photosensitive member of interest ($V_1/V_T$). Likewise, the mean of the volume $V_2$ of aluminum-doped tin-oxide-coated particles per 8 $\mu m^3$ at a total of ten points divided by $V_T$ (8 $\mu m^3$) was defined as the volume of aluminum-doped tin-oxide-coated particles in the undercoat layer of the electrophotographic photosensitive member of interest ($V_2/V_T$).

The area of particles was determined from the information from each cross-section through image analysis. The image analysis was performed using the image processing software below.

Image processing software: Media Cybernetics Image-Pro Plus

The undercoat layer may contain a surface-roughening material for reduced interference fringes. The surface-roughening material can be resin particles having an average particle diameter of 1 μm or more and 5 μm or less (preferably, 3 μm or less). Examples of resin particles that can be used for this purpose include particles of curable resins such as curable rubbers, polyurethane, epoxy resin, alkyd resin, phenolic resin, polyesters, silicone resin, and acrylic melamine resin. In particular, particles of silicone resin, acrylic melamine resin, and polymethyl methacrylate resin are preferred. The surface-roughening material content can be 1% to 80% by mass, preferably 1% to 40% by mass, based on the binder resin content of the undercoat layer.

The coating liquid for forming an undercoat layer may contain a leveling agent for enhanced surface characteristics of the undercoat layer. Likewise, the undercoat layer may contain pigment particles for improved masking properties.

Support

The support can be a conductive one (a conductive support). Examples include metal supports made of a metal or an alloy, such as aluminum, aluminum alloy, and stainless steel supports. When made of aluminum or an aluminum alloy, the support can be an aluminum tube produced through a process that includes extrusion and drawing, and can also be an aluminum tube produced through a process that includes extrusion and ironing.

Between the undercoat layer and the photosensitive layer, an intermediate layer may be interposed to serve as an electric barrier that prevents charge injection from the undercoat layer to the photosensitive layer.

The intermediate layer can be formed by applying a coating liquid containing a resin (binder resin) (hereinafter a coating liquid for forming an intermediate layer) to the undercoat layer and subsequent drying.

Examples of resins (binder resins) used in the intermediate layer include polyvinyl alcohol, polyvinyl methyl ether, polyacrylates, methylcellulose, ethylcellulose, polyglutamic acid, polyamides, polyimides, polyamide-imides, polyamic acids, melamine resin, epoxy resin, polyurethane, and polyglutamates.

The thickness of the intermediate layer can be 0.1 μm or more and 2 μm or less.

The intermediate layer may contain a polymerized product of a composition that contains an electron transporting substance that has a reactive functional group (a polymerizable functional group) for improved flow of charge from the photosensitive layer to the support. During the formation of the photosensitive layer on the intermediate layer, this will prevent any material from dissolving out of the intermediate layer into the solvent in the coating liquid for forming a photosensitive layer.

Examples of electron transporting substances include quinone compounds, imide compounds, benzimidazole compounds, and cyclopentadienylidene compounds.

Examples of reactive functional groups include a hydroxy group, a thiol group, an amino group, a carboxyl group, and a methoxy group.

In the intermediate layer, the amount of the electron transporting substance having a reactive functional group in the composition can be 30% by mass or more and 70% by mass or less.

The following are some specific examples of electron transporting substances having a reactive functional group.

[Chem. 1]

(A1)

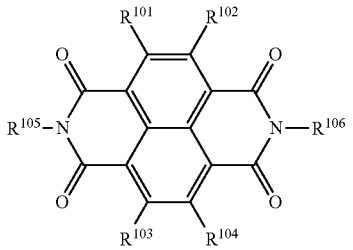

-continued (A2)

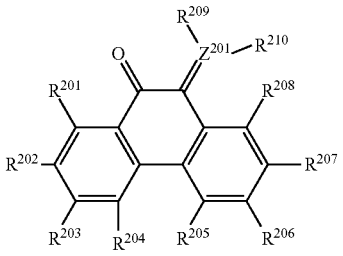

(A3)

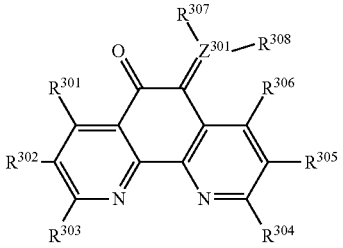

(A4)

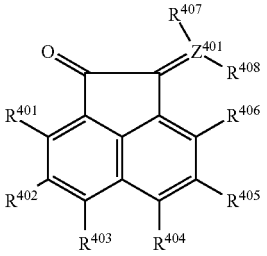

(A5)

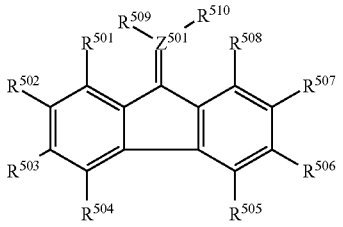

(A6)

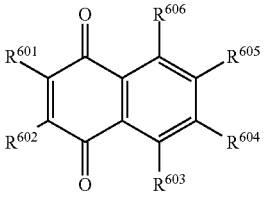

(A7)

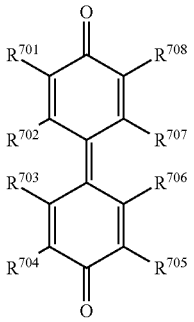

-continued (A8)

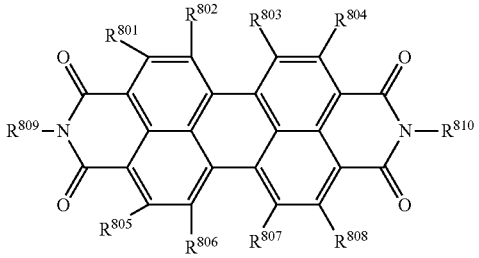

(A9)

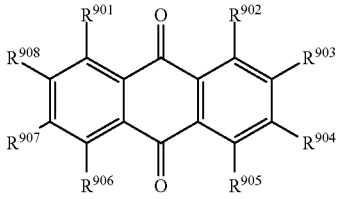

[Chem. 2]

(A10)

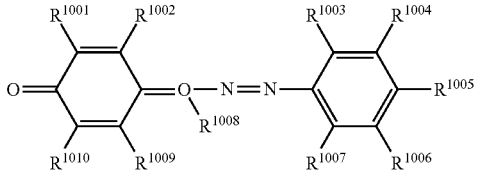

(A11)

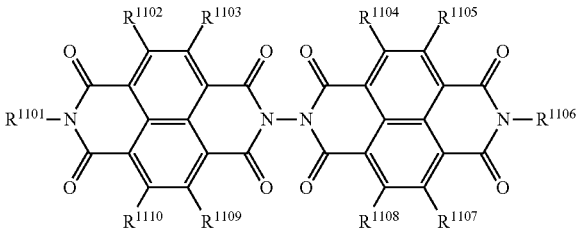

[Chem. 3]

(A12)

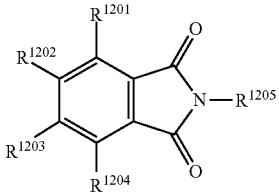

(A13)

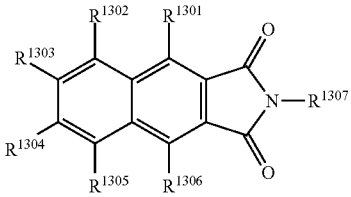

(A14)

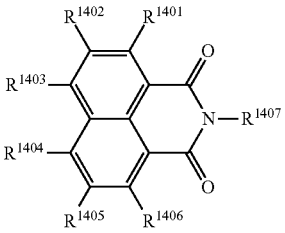

-continued (A15)

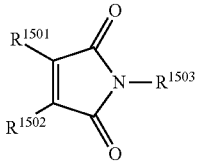

(A16)

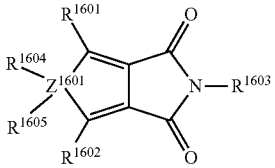

(A17)

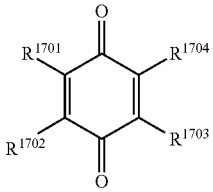

In formulae (A1) to (A17), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$, $R^{901}$ to $R^{908}$, $R^{1001}$ to $R^{1010}$, $R^{1101}$ to $R^{1110}$, $R^{1201}$ to $R^{1205}$, $R^{1301}$ to $R^{1307}$, $R^{1401}$ to $R^{1407}$, $R^{1501}$ to $R^{1503}$, $R^{1601}$ to $R^{1605}$, and $R^{1701}$ to $R^{1704}$ each independently represent a monovalent group represented by formula (1) or (2), a hydrogen atom, a cyano group, a nitro group, a halogen atom, an alkoxycarbonyl group, a substituted or unsubstituted alkyl group, a substituted or unsubstituted aryl group, or a substituted or unsubstituted heterocycle. The substituted alkyl group has a substituent selected from an alkyl group, an aryl group, a halogen atom, and a carbonyl group. The substituted aryl group or heterocyclic group has a substituent selected from a halogen atom, a nitro group, a cyano group, an alkyl group, a halogenated alkyl group, an alkoxy group, and a carbonyl group. $Z^{201}$, $Z^{301}$, $Z^{401}$, $Z^{501}$, and $Z^{1601}$ each independently represent a carbon atom, a nitrogen atom, or an oxygen atom. When $Z^{201}$ is an oxygen atom, $R^{209}$ and $R^{210}$ are empty, and when $Z^{201}$ is a nitrogen atom, $R^{210}$ is empty. When $Z^{301}$ is an oxygen atom, $R^{307}$ and $R^{309}$ are empty, and when $Z^{301}$ is a nitrogen atom, $R^{308}$ is empty. When $Z^{401}$ is an oxygen atom, $R^{407}$ and $R^{408}$ are empty, and when $Z^{401}$ is a nitrogen atom, $R^{408}$ is empty. When $Z^{501}$ is an oxygen atom, $R^{509}$ and $R^{510}$ are empty, and when $Z^{501}$ is a nitrogen atom, $R^{510}$ is empty. When $Z^{1601}$ is an oxygen atom, $R^{1604}$ and $R^{1605}$ are empty, and when $Z^{1601}$ is a nitrogen atom, $R^{1605}$ is empty. At least one of $R^{101}$ to $R^{106}$, at least one of $R^{201}$ to $R^{210}$, at least one of $R^{301}$ to $R^{308}$, at least one of $R^{401}$ to $R^{408}$, at least one of $R^{501}$ to $R^{510}$, at least one of $R^{601}$ to $R^{606}$, at least one of $R^{701}$ to $R^{708}$, at least one of $R^{801}$ to $R^{810}$, at least one of $R^{901}$ to $R^{908}$, at least one of $R^{1001}$ to $R^{1010}$, at least one of $R^{1101}$ to $R^{1110}$, at least one of $R^{1201}$ to $R^{1205}$, at least one of $R^{1301}$ to $R^{1307}$, at least one of $R^{1401}$ to $R^{1407}$, at least one of $R^{1501}$ to $R^{1503}$, at least one of $R^{1601}$ to $R^{1605}$, and at least one of $R^{1701}$ to $R^{1704}$ are groups represented by formula (1) or (2).

[Chem. 4]

(1)

$$-A$$

(2)

$$-(B)_l-C-D$$

In formulae (1) and (2), at least one of A, B, C, and D is a group having at least one reactive functional group, and the at least one reactive functional group is selected from a hydroxyl group, a thiol group, an amino group, and a carboxyl group.

The group denoted by A is a carboxyl group, an alkyl group containing 1 to 6 carbon atoms (hereinafter denoted by "$C_1$ to $C_6$"), an alkyl group having 1 to 6 main-chain atoms and substituted with a $C_1$ to $C_6$ alkyl group, a benzyl-substituted alkyl group having 1 to 6 main-chain atoms, or a phenyl-substituted alkyl group having 1 to 6 main-chain atoms. Each of these groups has a reactive functional group. The alkyl groups may have one of their backbone carbon atoms substituted by O or $NR^1$ (where $R^1$ is a hydrogen atom or an alkyl group).

The group denoted by B is an alkylene group having 1 to 6 main-chain atoms, an alkylene group having 1 to 6 main-chain atoms and substituted with a $C_1$ to $C_6$ alkyl group, a benzyl-substituted alkylene group having 1 to 6 main-chain atoms, or a phenyl-substituted alkylene group having 1 to 6 main-chain atoms. Each of these groups may have a reactive functional group. The alkylene groups may have one of their backbone carbon atoms substituted by O or $NR^2$ (where $R^2$ is a hydrogen atom or an alkyl group).

The subscript 1 is a number 0 or 1.

The group denoted by C is a phenylene group, a phenylene group having a $C_1$ to $C_6$ alkyl substituent, a nitro-substituted phenylene group, a halogenated phenylene group, or an alkoxy-substituted phenylene group. Each of these groups may have a reactive functional group.

The group denoted by D is a hydrogen atom, a $C_1$ to $C_6$ alkyl group, or an alkyl group having 1 to 6 main-chain atoms and substituted with a $C_1$ to $C_6$ alkyl group. Each of these groups may have a reactive functional group.

The following are specific examples of electron transporting substances having a reactive functional group. Table 1 is a list of some specific examples of compounds represented by formula (A1).

TABLE 1
| Illustrative compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A101 | H | H | H | H | 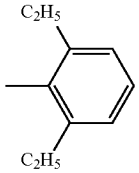 | (1) | 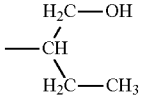 | — | — | — | — | — | — | — |
| A102 | H | H | H | H | 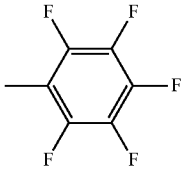 | (1) | —COOH | — | — | — | — | — | — | — |
| A103 | CN | H | H | CN | 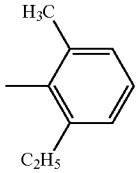 | (2) | — | — | 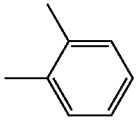 | 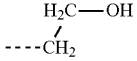 | — | — | — | — |
| A104 | H | NO2 | H | NO2 | 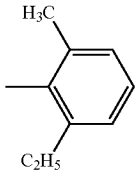 | (1) | 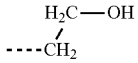 | — | — | — | — | — | — | — |
| A105 | F | H | H | F | (2) | (2) | — | — | 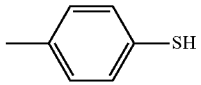 | — | — | — | — | — |

TABLE 1-continued
| Illustrative compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A106 | H | H | H | H | 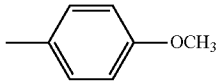 | (2) | — | — | 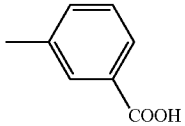 | — | — | — | — | — |
| A107 | H | H | H | H | 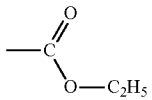 | (2) | — | — | 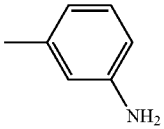 | — | — | — | — | — |
| A108 | H | H | H | H | 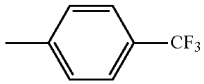 | (2) | — | — | 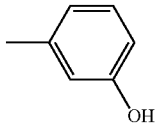 | — | — | — | — | — |
| A109 | H | H | H | H | 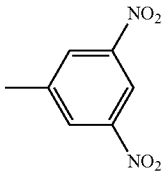 | (2) | — | — | 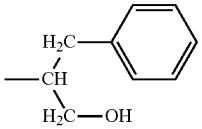 | — | — | — | — | — |
| A110 | H | H | H | H | 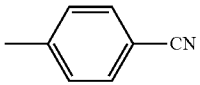 | (2) | — | — | 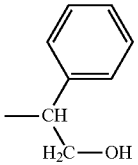 | — | — | — | — | — |
| A111 | H | H | H | H | 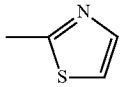 | (1) | 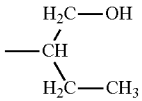 | — | — | — | — | — | — | — |

TABLE 1-continued
| Illustrative compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A112 | H | H | H | H | 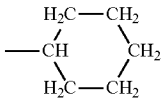 | (1) | 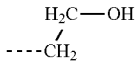 | — | — | — | — | — | — | — |
| A113 | H | H | H | H | 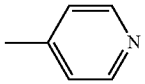 | (2) | — | 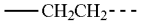 | 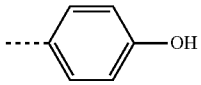 | — | — | — | — | — |
| A114 | H | H | H | H | 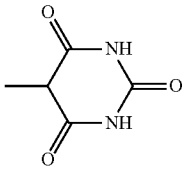 | (2) | — | — | 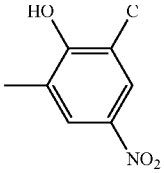 | — | — | — | — | — |
| A115 | H | H | H | H | $—C_2H_4—O—C_2H_5$ | (2) | — | — | 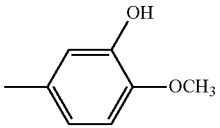 | — | — | — | — | — |
| A116 | H | H | H | H | 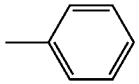 | (1) | 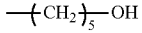 | — | — | — | — | — | — | — |
| A117 | H | H | H | H | (2) | (2) | — | — | 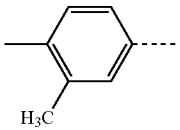 | 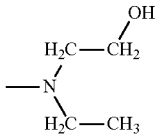 | — | — | — | — |

TABLE 1-continued
| Illustrative compound | $R^{101}$ | $R^{102}$ | $R^{103}$ | $R^{104}$ | $R^{105}$ | $R^{106}$ | (1) A | (2) B | (2) C | (2) D | (1)' A | (2)' B | (2)' C | (2)' D |
|---|---|---|---|---|---|---|---|---|---|---|---|---|---|---|
| A118 | H | H | H | H | (2) | (1)' | — | — | 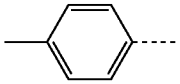 | 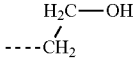 | 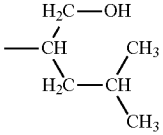 | — | — | — |
| A119 | H | H | H | H | (1) | (1) | 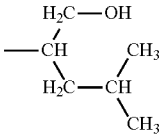 | — | — | — | — | — | — | — |
| A120 | H | H | H | H | (1) | (1)' | 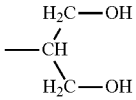 | — | — | — | 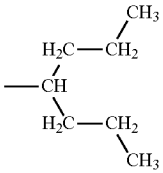 | — | — | — |

Table 2 is a list of some specific examples of compounds represented by formula (A2).
TABLE 2
| Illustrative compound | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $Z^{201}$ |
|---|---|---|---|---|---|---|---|---|---|---|---|
| A201 | H | (1) | H | H | H | H | (2)' | H | — | — | 0 |
| A202 | H | (2) | H | H | H | H | (1)' | H | — | — | 0 |
| A203 | H | (2) | H | H | H | H | (1)' | H | — | — | 0 |
| A204 | CH3 | H | H | H | H | H | H | $CH_3$ | (2) | — | N |
| A205 | H | Cl | H | H | H | H | Cl | H | (2) | — | N |
| A206 | H | H | 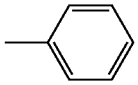 | H | H | 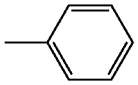 | H | H | (2) | — | N |
| A207 | H | H | 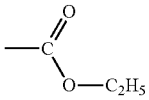 | H | H | 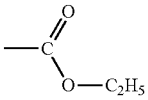 | H | H | (2) | — | N |
| A208 | H | H | (2) | H | H | (2) | H | H | CN | CN | C |
| A209 | H | H | (2) | H | H | (2) | H | H | CN | CN | C |
| Illustrative compound | (1) | (2) | | | (1)' | (2)' | | |
|---|---|---|---|---|---|---|---|---|
| | A | B | C | D | A | B | C | D |
| A201 | 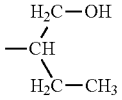 | — | — | — | — | — | 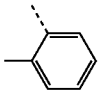 | 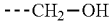 |
| A202 | — | — | 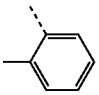 | 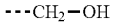 | 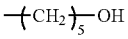 | — | — | — |
| A203 | — | — | 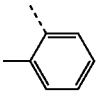 | 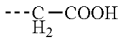 | 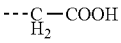 | — | — | — |
| A204 | — | — | 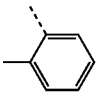 | 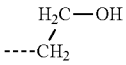 | — | — | — | — |
| A205 | — | — | 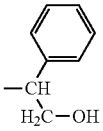 | — | — | — | — | — |
| A206 | — | — | 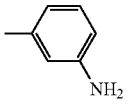 | — | — | — | — | — |
| A207 | — | — | 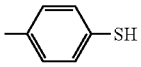 | — | — | — | — | — |
| A208 | — | — | 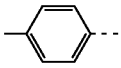 | 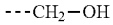 | — | — | — | — |

TABLE 2-continued
| | | | | | | | | |
|---|---|---|---|---|---|---|---|---|
| A209 | —$CH_2CH_2$- - | — | 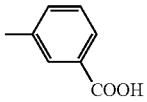 | — | — | — | — | — |
Table 3 is a list of some specific examples of compounds represented by formula (A3).

TABLE 3
| Illustrative compound | $R^{301}$ | $R^{302}$ | $R^{303}$ | $R^{304}$ | $R^{305}$ | $R^{306}$ | $R^{307}$ | $R^{308}$ | $Z^{301}$ | (1) A | (2) B | (2) C | (2) D | (1)' A | (2)' B | (2)' C | (2)' D |
|---|---|---|---|---|---|---|---|---|---|---|---|---|---|---|---|---|---|
| A301 | H | (1) | H | H | (2)' | H | — | — | 0 | $H_2C-OH$ / $-CH$ \ $H_2C-CH_3$ | — | — | — | — | — | 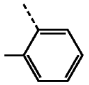 | $---CH_2-OH$ |
| A302 | H | (2) | H | H | (1)' | H | — | — | 0 | — | — | 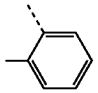 | $---CH_2-OH$ | $-(CH_2)_5-OH$ | — | — | — |
| A303 | H | (2) | H | H | (1)' | H | — | — | 0 | — | — | 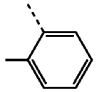 | $----C(H_2)-COOH$ | $----C(H_2)-COOH$ | — | — | — |
| A304 | H | H | H | H | H | H | (2) | — | N | — | — | 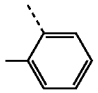 | $H_2C-OH$ / $----CH_2$ | — | — | — | — |
| A305 | H | Cl | H | H | Cl | H | (2) | — | N | — | — | 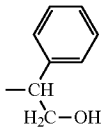 | — | — | — | — | — |

TABLE 3-continued
| Illustrative compound | $R^{301}$ | $R^{302}$ | $R^{303}$ | $R^{304}$ | $R^{305}$ | $R^{306}$ | $R^{307}$ | $R^{308}$ | $Z^{301}$ | (1) A | (2) B | (2) C | (2) D | (1)' A | (2)' B | (2)' C | (2)' D |
|---|---|---|---|---|---|---|---|---|---|---|---|---|---|---|---|---|---|
| A306 | H | H | 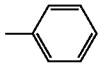 | 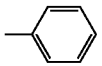 | H | H | (2) | — | N | — | — | 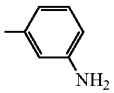 | — | — | — | — | — |
| A307 | H | H | 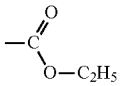 | 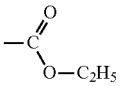 | H | H | (2) | — | N | — | — | 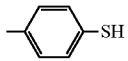 | — | — | — | — | — |
| A308 | H | H | (2) | (2) | H | H | CN | CN | C | — | — | 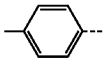 | ---$CH_2$—OH | — | — | — | — |
| A309 | H | H | (2) | (2) | H | H | CN | CN | C | — | —$CH_2CH_2$-- | 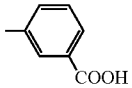 | — | — | — | — | — |

Table 4 is a list of some specific examples of compounds represented by formula (A4).

TABLE 4
| Illustrative compound | $R^{401}$ | $R^{402}$ | $R^{403}$ | $R^{404}$ | $R^{405}$ | $R^{406}$ | $R^{407}$ | $R^{408}$ | $Z^{401}$ | (1) A | (2) B | (2) C | (2) D |
|---|---|---|---|---|---|---|---|---|---|---|---|---|---|
| A401 | H | Cl | H | H | Cl | H | (2) | — | N | — | — | 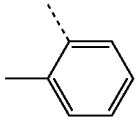 | 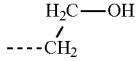 |
| A402 | H | H | 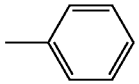 | 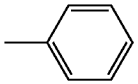 | H | H | (2) | — | N | — | — | 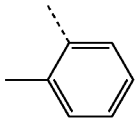 | 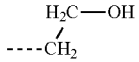 |
| A403 | H | H | 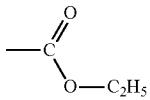 | 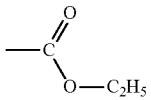 | H | H | (2) | — | N | — | — | 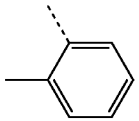 | 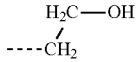 |
| A405 | H | H | (2) | (2) | H | H | — | — | O | — | — | 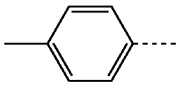 | 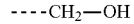 |
| A408 | H | H | (2) | (2) | H | H | — | — | O | — | — | 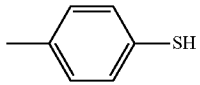 | — |
| A409 | H | H | (2) | (2) | H | H | — | — | O | — | 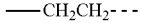 | 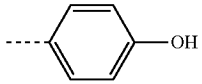 | — |
| A410 | H | H | (1) | (1) | H | H | CN | CN | C | 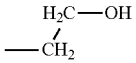 | — | — | — |
| A411 | H | H | (1) | (1) | H | H | CN | CN | C | COOH | — | — | — |
| A412 | H | H | (1) | (1) | H | H | CN | CN | C | $NH_2$ | — | — | — |

Table 5 is a list of some specific examples of compounds represented by formula (A5).

TABLE 5
| Illustrative compound | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | (1) A | (2) B | (2) C | (2) D |
|---|---|---|---|---|---|---|---|---|---|---|---|---|---|---|---|
| A501 | H | (2) | H | H | H | H | (2) | H | — | — | O | — | — | 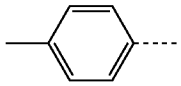 | ----$CH_2$—OH |
| A502 | H | (2) | H | H | H | H | (2) | H | — | — | O | — | — | 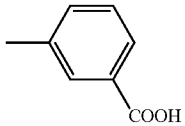 | — |
| A503 | H | (2) | H | H | H | H | (2) | H | — | — | O | — | — | 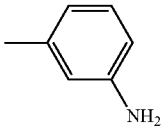 | — |
| A504 | H | (2) | H | H | H | H | (2) | H | 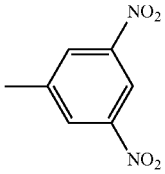 | — | N | — | — | 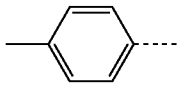 | ----$CH_2$—OH |
| A505 | H | H | H | H | H | H | H | H | (1) | — | N | 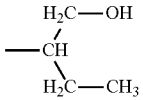 | — | — | — |

TABLE 5-continued
| Illustrative compound | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | (1) A | (2) B | (2) C | (2) D |
|---|---|---|---|---|---|---|---|---|---|---|---|---|---|---|---|
| A506 | $CH_3$ | H | H | H | H | H | H | $CH_3$ | (2) | — | N | — | — | 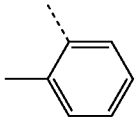 | $H_2C$—OH<br>----$CH_2$ |
| A507 | H | (1) | H | H | H | H | (1) | H | CN | CN | C | NH2 | — | — | — |
| A508 | H | H | (2) | H | H | (2) | H | H | CN | CN | C | — | — | 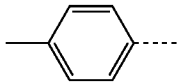 | ----$CH_2$—OH |
| A509 | H | (2) | H | H | H | H | (2) | H | CN | CN | C | — | —$CH_2CH_2$--- | 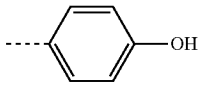 | — |

Table 6 is a list of some specific examples of compounds represented by formula (A6).
TABLE 6
| Illustrative compound | $R^{601}$ | $R^{602}$ | $R^{603}$ | $R^{604}$ | $R^{605}$ | $R^{606}$ | (1) A | (2) B | (2) C | (2) D |
|---|---|---|---|---|---|---|---|---|---|---|
| A601 | (2) | H | H | H | H | H | — | — | 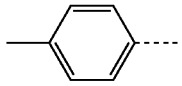 | ---$CH_2$—OH |
| A602 | (2) | H | H | H | H | H | — | — | 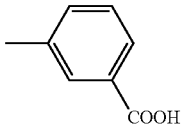 | — |
| A603 | (2) | H | H | H | H | H | — | — | 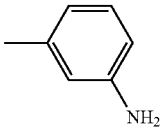 | — |
| A604 | (2) | H | H | H | H | H | — | — | 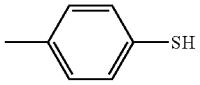 | — |
| A605 | (2) | H | H | H | H | H | — | —$CH_2CH_2$--- | 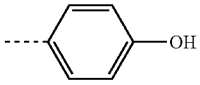 | — |
| A606 | (1) | H | H | H | H | H | 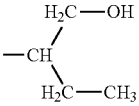 | — | — | — |
| A607 | CN | CN | (1) | H | H | H | NH2 | — | — | — |
| A608 | (2) | (2) | H | H | H | H | — | — | 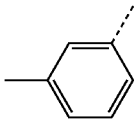 | ---$CH_2$—OH |
| A609 | (1) | (1) | H | H | H | H | 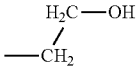 | — | — | — |
| A610 | (1) | (1) | H | H | H | H | COOH | — | — | — |
Table 7 is a list of some specific examples of compounds represented by formula (A7).

TABLE 7
| Illustrative compound | $R^{701}$ | $R^{702}$ | $R^{703}$ | $R^{704}$ | $R^{705}$ | $R^{706}$ | $R^{707}$ | $R^{708}$ | (1) A | (2) B | (2) C | (2) D | (1)' A | (2)' B | (2)' C | (2)' D |
|---|---|---|---|---|---|---|---|---|---|---|---|---|---|---|---|---|
| A701 | (1) | H | H | H | (2)' | H | H | H | 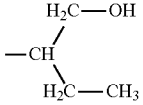 | — | — | — | — | — | 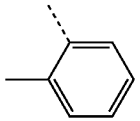 | ---$CH_2$—OH |
| A702 | (2) | H | H | H | (1)' | H | H | H | — | — | 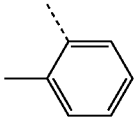 | ---$CH_2$—OH | —$(CH_2)_5$—OH | — | — | — |
| A703 | (2) | H | H | H | (1)' | H | H | H | — | — | 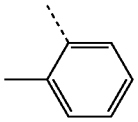 | ----C(H$_2$)—COOH | ----C(H$_2$)—COOH | — | — | — |
| A704 | (2) | H | H | H | H | H | H | H | — | — | 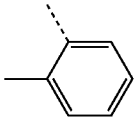 | ----$CH_2$—$H_2C$—OH | — | — | — | — |
| A705 | (2) | H | H | H | H | H | H | H | — | — | 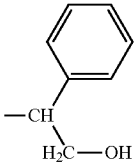 | — | — | — | — | — |
| A706 | (2) | H | H | H | H | H | H | H | — | — | 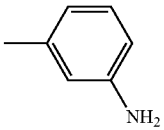 | — | — | — | — | — |
| A707 | (2) | H | H | H | H | H | H | H | — | — | 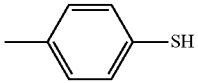 | — | — | — | — | — |

TABLE 7-continued
| Illustrative compound | $R^{701}$ | $R^{702}$ | $R^{703}$ | $R^{704}$ | $R^{705}$ | $R^{706}$ | $R^{707}$ | $R^{708}$ | (1) A | (2) B | (2) C | (2) D | (1)' A | (2)' B | (2)' C | (2)' D |
|---|---|---|---|---|---|---|---|---|---|---|---|---|---|---|---|---|
| A708 | (2) | H | H | H | (2) | H | H | H | — | — | 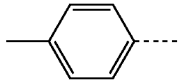 | ---$CH_2$—OH | — | — | — | — |
| A709 | (2) | H | H | H | (2) | H | H | H | — | —$CH_2CH_2$--- | 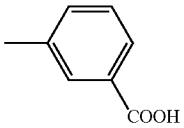 | — | — | — | — | — |

Table 8 is a list of some specific examples of compounds represented by formula (A8).

TABLE 8
| Illustrative compound | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | (1) A | (2) B | (2) C | (2) D | (1)' A | (2)' B | (2)' C | (2)' D |
|---|---|---|---|---|---|---|---|---|---|---|---|---|---|---|---|---|---|---|
| A801 | H | H | H | H | H | H | H | H | (1) | (1)' | $H_2C-OH$ / $-CH$ / $H_2C-CH_3$ | — | — | — | $-(CH_2)_5-OH$ | — | — | — |
| A802 | H | H | H | H | H | H | H | H | (2) | (1)' | — | — | 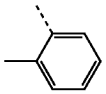 | ---$CH_2$—OH | $-(CH_2)_5-OH$ | — | — | — |
| A803 | H | H | H | H | H | H | H | H | (2) | (1)' | — | — | 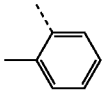 | ---C—COOH / $H_2$ | ---C—COOH / $H_2$ | — | — | — |
| A804 | H | H | H | H | H | H | H | H | (2) | (2)' | — | — | 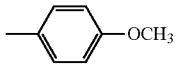 | — | — | — | 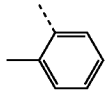 | ---$CH_2$—OH |
| A805 | H | Cl | Cl | H | H | Cl | Cl | H | 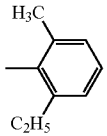 | (1) | $H_2C-OH$ / $-CH$ / $H_2C-CH_3$ | — | — | — | — | — | — | — |
| A806 | H | H | H | H | H | H | H | H | 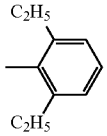 | (2) | — | — | 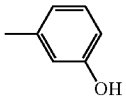 | — | — | — | — | — |
| A807 | H | H | H | H | H | H | H | H | 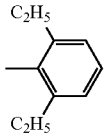 | (2) | — | — | 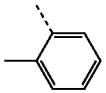 | $H_2C-OH$ / ---$CH_2$ | — | — | — | — |

TABLE 8-continued
| Illustrative compound | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | (1) A | (2) B | (2) C | (2) D | (1)' A | (2)' B | (2)' C | (2)' D |
|---|---|---|---|---|---|---|---|---|---|---|---|---|---|---|---|---|---|---|
| A808 | H | H | H | H | H | H | H | H | (2) | (2) | — | —$CH_2CH_2$--- | 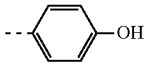 | — | — | — | — | — |
| A809 | H | H | H | H | H | H | H | H | (2) | (1)' | — | — | 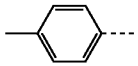 | 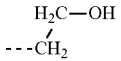 | 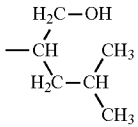 | — | — | — |
| A810 | H | H | H | H | H | H | H | H | (1) | (1) | 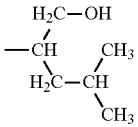 | — | — | — | — | — | — | — |
| A811 | H | H | H | H | H | H | H | H | (1) | (1)' | 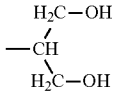 | — | — | — | 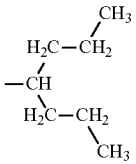 | — | — | — |

Table 9 is a list of some specific examples of compounds represented by formula (A9).

TABLE 9
| Illustrative compound | $R^{901}$ | $R^{902}$ | $R^{903}$ | $R^{904}$ | $R^{905}$ | $R^{906}$ | $R^{907}$ | $R^{908}$ | (1) A | (2) B | (2) C | (2) D | (1)' A | (2)' B | (2)' C | (2)' D |
|---|---|---|---|---|---|---|---|---|---|---|---|---|---|---|---|---|
| A901 | (1) | H | H | H | H | H | H | H | —$CH_2$—OH | — | — | — | — | — | — | — |
| A902 | (1) | H | H | H | H | H | H | H | —$(CH_2)_2$—OH | — | — | — | — | — | — | — |
| A903 | (1) | H | H | H | (1)' | H | H | H | — | —$CH_2CH_2$--- | 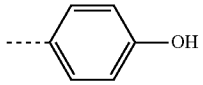 | — | —$CH_2$—COOH | — | — | — |
| A904 | (1) | H | H | H | (1)' | H | H | H | —$(CH_2)_2$—OH | — | — | — | — | — | 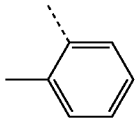 | ---$CH_2$—OH |
| A905 | H | H | H | H | H | H | H | (2) | — | — | 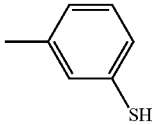 | — | — | — | — | — |
| A906 | H | H | H | H | H | H | H | (2) | — | — | 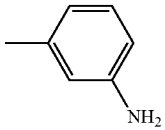 | — | — | — | — | — |
| A907 | H | H | H | H | H | H | H | (2) | — | — | 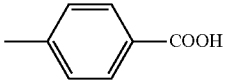 | — | — | — | — | — |
| A908 | H | CN | H | H | H | H | CN | (2) | — | — | 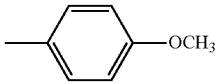 | — | — | — | — | — |

TABLE 9-continued
| Illustrative compound | $R^{901}$ | $R^{902}$ | $R^{903}$ | $R^{904}$ | $R^{905}$ | $R^{906}$ | $R^{907}$ | $R^{908}$ | (1) A | (2) B | (2) C | (2) D | (1)' A | (2)' B | (2)' C | (2)' D |
|---|---|---|---|---|---|---|---|---|---|---|---|---|---|---|---|---|
| A909 | (2) | H | H | H | (2) | H | H | H | — | — | 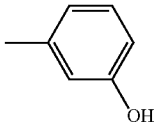 | — | — | — | — | — |
| A910 | (1) | H | H | (2)' | H | H | H | H | $-(CH_2)_2-OH$ | — | — | — | — | — | 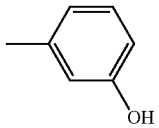 | — |
| A911 | H | (2)' | H | H | H | H | H | (1) | $-(CH_2)_6-OH$ | — | — | — | — | — | 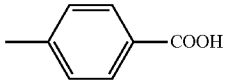 | — |

Table 10 is a list of some specific examples of compounds represented by formula (A10)

TABLE 10

| Illustrative compound | $R^{1001}$ | $R^{1002}$ | $R^{1003}$ | $R^{1004}$ | $R^{1005}$ | $R^{1006}$ | $R^{1007}$ | $R^{1008}$ | $R^{1009}$ | $R^{1010}$ | (1) A | (2) B | (2) C | (2) D |
|---|---|---|---|---|---|---|---|---|---|---|---|---|---|---|
| A1001 | 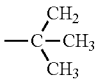 | H | H | H | H | (1) | H | H | H | 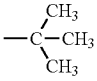 | —$CH_2$—OH | — | — | — |
| A1002 | 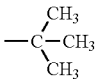 | H | H | H | H | (2) | H | H | H | 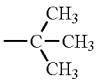 | — | — | 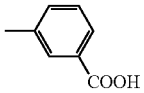 | — |
| A1003 | 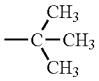 | H | H | H | H | (2) | H | H | H | 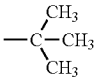 | — | —$CH_2CH_2$--- | 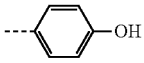 | — |
| A1004 | 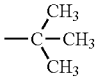 | H | H | H | H | (2) | H | H | H | 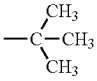 | — | — | 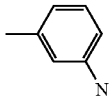 | — |
| A1005 | 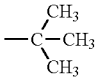 | H | H | H | H | (2) | H | H | H | 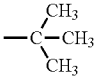 | — | — | 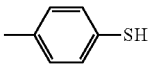 | — |
| A1006 | 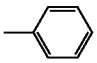 | H | H | H | H | (1) | H | H | H | 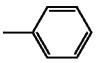 | —$CH_2$—OH | — | — | — |
| A1007 | 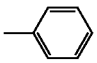 | H | H | H | H | (2) | H | H | H | 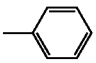 | — | — | 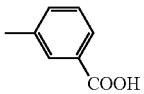 | — |
| A1008 | 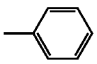 | H | H | H | H | (2) | H | H | H | 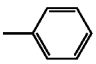 | — | —$CH_2CH_2$--- | 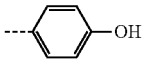 | — |
| A1009 | 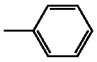 | H | H | H | H | (2) | H | H | H | 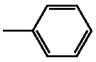 | — | — | 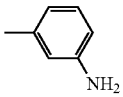 | — |
| A1010 | 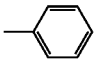 | H | H | H | H | (2) | H | H | H | 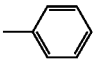 | — | — | 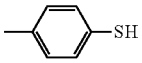 | — |

Table 11 is a list of some specific examples of compounds represented by formula (A11).

TABLE 11
| Compound No. | $R^{1101}$ | $R^{1102}$ | $R^{1103}$ | $R^{1104}$ | $R^{1105}$ | $R^{1106}$ | $R^{1107}$ | $R^{1108}$ | $R^{1109}$ | $R^{1110}$ | (1) A | (2) B | (2) C | (2) D | (1)' A | (2)' B | (2)' C | (2)' D |
|---|---|---|---|---|---|---|---|---|---|---|---|---|---|---|---|---|---|---|
| A1101 | (1) | H | H | H | H | (1) | H | H | H | H | 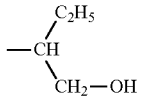 | — | — | — | — | — | — | — |
| A1102 | (2) | H | H | H | H | (1)' | H | H | H | H | — | — | 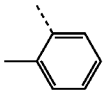 | ---$CH_2$—OH | —($CH_2$)$_5$—OH | — | — | — |
| A1103 | (2) | H | H | H | H | (1)' | H | H | H | H | — | — | 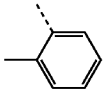 | ---C($H_2$)—COOH | ---C($H_2$)—COOH | — | — | — |
| A1104 | (2) | H | H | H | H | (2)' | H | H | H | H | — | — | 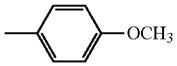 | — | — | — | 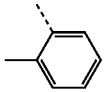 | ---$CH_2$—OH |
| A1105 | 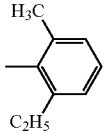 | H | Cl | Cl | H | (1) | H | Cl | Cl | H | 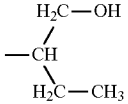 | — | — | — | — | — | — | — |
| A1106 | 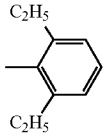 | H | H | H | H | (2) | H | H | H | H | — | — | 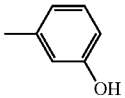 | — | — | — | — | — |
| A1107 | 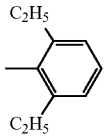 | H | H | H | H | (2) | H | H | H | H | — | — | 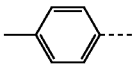 | ---C($H_2$)—COOH | — | — | — | — |

TABLE 11-continued
| Compound No. | $R^{1101}$ | $R^{1102}$ | $R^{1103}$ | $R^{1104}$ | $R^{1105}$ | $R^{1106}$ | $R^{1107}$ | $R^{1108}$ | $R^{1109}$ | $R^{1110}$ | (1) A | (2) B | (2) C | (2) D | (1)' A | (2)' B | (2)' C | (2)' D |
|---|---|---|---|---|---|---|---|---|---|---|---|---|---|---|---|---|---|---|
| A1108 | (2) | H | H | H | H | (2) | H | H | H | H | — | —$CH_2CH_2$--- | 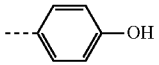 | — | — | — | — | — |
| A1109 | (2) | H | H | H | H | (1)' | H | H | H | H | — | — | 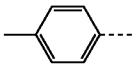 | 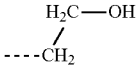 | 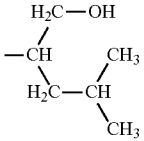 | — | — | — |
| A1110 | (1) | H | H | H | H | (1) | H | H | H | H | 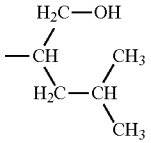 | — | — | — | — | — | — | — |
| A1111 | (1) | H | H | H | H | (1)' | H | H | H | H | 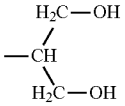 | — | — | — | 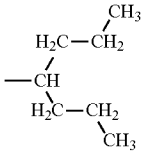 | — | — | — |

Table 12 is a list of some specific examples of compounds represented by formula (A12).
TABLE 12
| Compound | | | | | | (1) | (2) | | |
|---|---|---|---|---|---|---|---|---|---|
| No. | $R^{1201}$ | $R^{1202}$ | $R^{1203}$ | $R^{1204}$ | $R^{1205}$ | A | B | C | D |
| A1201 | H | $NO_2$ | H | H | (2) | — | — | 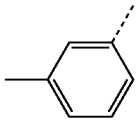 | ---$CH_2$—OH |
| A1202 | H | F | H | H | (2) | — | — | 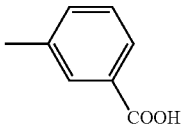 | — |
| A1203 | H | CN | H | H | (2) | — | — | 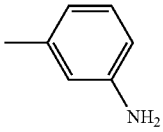 | — |
| A1204 | H | 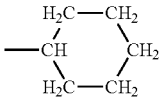 | H | H | (2) | — | — | 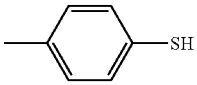 | — |
| A1205 | H | H | H | H | (2) | — | —$CH_2CH_2$--- | 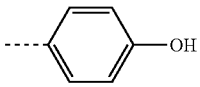 | — |
| A1206 | H | H | H | H | (1) | 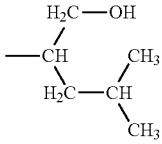 | — | — | — |
| A1207 | H | H | H | H | (1) | 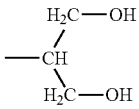 | — | — | — |
| A1208 | H | (1) | (1) | H | H | 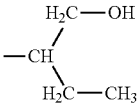 | — | — | — |
| A1209 | H | (1) | (1) | H | H | COOH | — | — | — |
Table 13 is a list of some specific examples of compounds represented by formula (A13).
TABLE 13
| Compound | | | | | | | (1) | (2) | | |
|---|---|---|---|---|---|---|---|---|---|---|
| No. | $R^{1301}$ | $R^{1302}$ | $R^{1303}$ | $R^{1304}$ | $R^{1305}$ | $R^{1306}$ | $R^{1307}$ | A | B | C | D |
| A1301 | H | H | H | H | H | H | (2) | — | — | 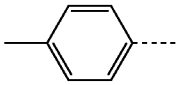 | ---$CH_2$—OH |

TABLE 13-continued
| Compound | | | | | | | | (1) | (2) | | |
|---|---|---|---|---|---|---|---|---|---|---|---|
| No. | $R^{1301}$ | $R^{1302}$ | $R^{1303}$ | $R^{1304}$ | $R^{1305}$ | $R^{1306}$ | $R^{1307}$ | A | B | C | D |
| A1302 | H | H | $NO_2$ | H | H | H | (2) | — | — | 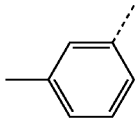 | ---$CH_2$—OH |
| A1303 | H | H | F | H | H | H | (2) | — | — | 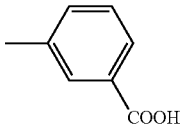 | — |
| A1304 | H | H | CN | H | H | H | (2) | — | — | 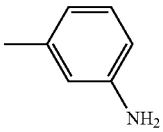 | — |
| A1305 | H | H | 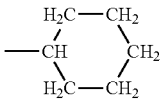 | H | H | H | (2) | — | — | 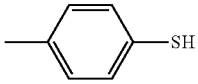 | — |
| A1306 | H | H | H | H | H | H | (2) | — | —$CH_2CH_2$--- | 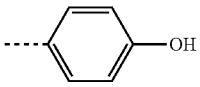 | — |
| A1307 | H | H | —C6H13 | H | H | H | (1) | NH2 | — | — | — |
| A1308 | H | H | (2) | (2) | H | H | H | — | — | 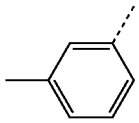 | ---$CH_2$—OH |
| A1309 | H | H | (1) | (1) | H | H | H | 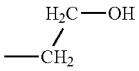 | — | — | — |
Table 14 is a list of some specific examples of compounds represented by formula (A14).
TABLE 14
| Compound | | | | | | | | (1) | (2) | | |
|---|---|---|---|---|---|---|---|---|---|---|---|
| No. | $R^{1401}$ | $R^{1402}$ | $R^{1403}$ | $R^{1404}$ | $R^{1405}$ | $R^{1406}$ | $R^{1407}$ | A | B | C | D |
| A1401 | H | H | H | H | H | H | (2) | — | — | 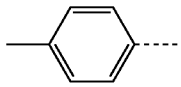 | ---$CH_2$—OH |
| A1402 | H | H | NO2 | H | H | H | (2) | — | — | 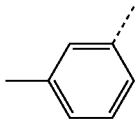 | ---$CH_2$—OH |
| A1403 | H | H | F | H | H | H | (2) | — | — | 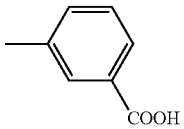 | — |

TABLE 14-continued
| Compound | | | | | | | (1) | (2) | | |
|---|---|---|---|---|---|---|---|---|---|---|
| No. | $R^{1401}$ | $R^{1402}$ | $R^{1403}$ | $R^{1404}$ | $R^{1405}$ | $R^{1406}$ | $R^{1407}$ | A | B | C | D |
| A1404 | H | H | CN | H | H | H | (2) | — | — | 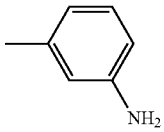 | — |
| A1405 | H | H | 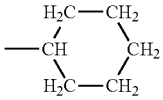 | | H | H | (2) | — | — | 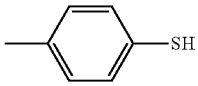 | — |
| A1406 | H | H | H | H | H | H | (2) | — | —$CH_2CH_2$--- | 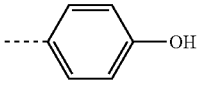 | — |
| A1407 | H | H | H | H | H | H | (1) | 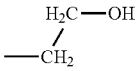 | — | — | — |
| A1408 | H | H | (2) | (2) | H | H | H | | | 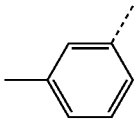 | ---$CH_2$—OH |
| A1409 | H | H | (1) | (1) | H | H | H | 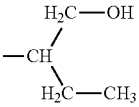 | — | — | — |
| A1410 | H | H | (1) | (1) | H | H | H | COOH | — | — | — |
Table 15 is a list of some specific examples of compounds represented by formula (A15).
TABLE 15
| Compound | | | | (1) | (2) | | |
|---|---|---|---|---|---|---|---|
| No. | $R^{1501}$ | $R^{1502}$ | $R^{1503}$ | A | B | C | D |
| A1501 | H | H | (2) | — | — | 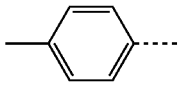 | ---$CH_2$—OH |
| A1502 | $NO_2$ | H | (2) | — | — | 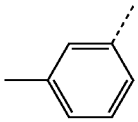 | ---$CH_2$—OH |
| A1503 | F | H | (2) | — | — | 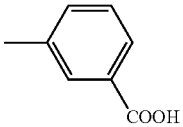 | — |
| A1504 | 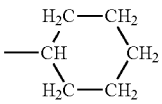 | H | (2) | — | — | 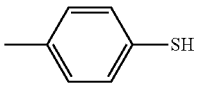 | — |

TABLE 15-continued
| Compound | | | | (1) | (2) | | |
|---|---|---|---|---|---|---|---|
| No. | $R^{1501}$ | $R^{1502}$ | $R^{1503}$ | A | B | C | D |
| A1505 | H | H | (1) | 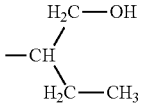 | — | — | — |
| A1506 | H | H | (1) | 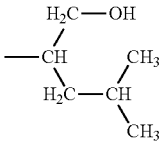 | — | — | — |
| A1507 | —C6H13 | H | (1) | NH2 | — | — | — |
| A1508 | (2) | (2) | H | — | — | 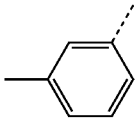 | ---$CH_2$—OH |
| A1509 | (1) | (1) | H | 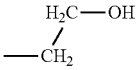 | — | — | — |
Table 16 is a list of some specific examples of compounds represented by formula (A16).
TABLE 16
| Compound | | | | | | | (1) | (2) | | |
|---|---|---|---|---|---|---|---|---|---|---|
| No. | $R^{1601}$ | $R^{1602}$ | $R^{1603}$ | $R^{1604}$ | $R^{1605}$ | $Z^{1601}$ | A | B | C | D |
| A1601 | H | H | (2) | H | H | C | — | — | 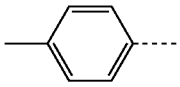 | ---$CH_2$—OH |
| A1602 | CN | H | (2) | H | H | C | — | — | 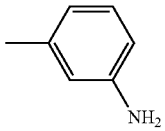 | — |
| A1603 | H | H | (2) | H | H | C | — | —$CH_2CH_2$--- | 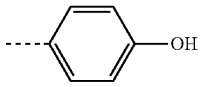 | — |
| A1604 | H | H | (1) | — | — | O | 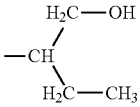 | — | — | — |
| A1605 | H | H | (1) | — | — | O | 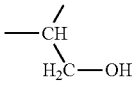 | — | — | — |
| A1606 | —C6H13 | H | (1) | H | — | N | NH2 | — | — | — |

TABLE 16-continued
| Compound | | | | | | | (1) | (2) | | |
|---|---|---|---|---|---|---|---|---|---|---|
| No. | $R^{1601}$ | $R^{1602}$ | $R^{1603}$ | $R^{1604}$ | $R^{1605}$ | $Z^{1601}$ | A | B | C | D |
| A1607 | (2) | (2) | H | H | H | C | — | — | 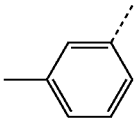 | ---$CH_2$—OH |
| A1608 | (1) | (1) | H | H | H | C | COOH | — | — | — |
Table 17 is a list of some specific examples of compounds represented by formula (A17).
TABLE 17
| Compound | | | | | (1) | (2) | | |
|---|---|---|---|---|---|---|---|---|
| No. | $R^{1701}$ | $R^{1702}$ | $R^{1703}$ | $R^{1704}$ | A | B | C | D |
| A1701 | (2) | H | H | H | — | — | 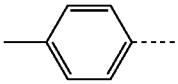 | ---$CH_2$—OH |
| A1702 | (2) | H | H | $NO_2$ | — | — | 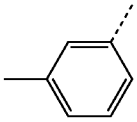 | ---$CH_2$—OH |
| A1703 | (2) | H | H | H | — | — | 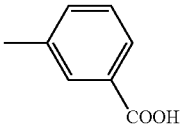 | — |
| A1704 | (2) | H | H | H | — | — | 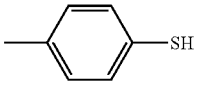 | — |
| A1705 | (2) | H | H | H | — | —$CH_2CH_2$--- | 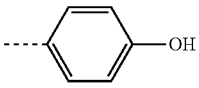 | — |
| A1706 | (1) | H | H | H | 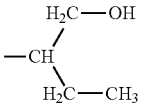 | — | — | — |
| A1707 | (1) | F | H | H | COOH | — | — | — |
| A1708 | (1) | CN | H | H | COOH | — | — | — |
| A1709 | (1) | 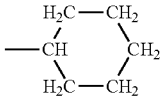 | H | H | COOH | — | — | — |
| A1710 | (1) | H | 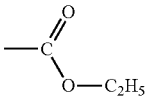 | H | COOH | — | — | — |
| A1711 | (2) | H | (2) | H | — | — | 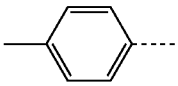 | ---$CH_2$—OH |

TABLE 17-continued

| Compound | | | | | (1) | (2) | | |
|---|---|---|---|---|---|---|---|---|
| No. | $R^{1701}$ | $R^{1702}$ | $R^{1703}$ | $R^{1704}$ | A | B | C | D |
| A1712 | (2) | $NO_2$ | (2) | $NO_2$ | — | — | 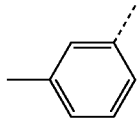 | ---$CH_2$—OH |
| A1713 | (2) | H | (2) | H | — | — | 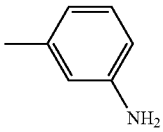 | — |

Derivatives (derivatives of electron transporting substances) having any of the structures represented by (A2) to (A6), (A9), (A12) to (A15), and (A17) are commercially available from Tokyo Chemical Industry, Sigma-Aldrich Japan, or Johnson Matthey Japan Incorporated. Derivatives having a structure represented by (A1) can be synthesized through the reaction between naphthalenetetracarboxylic dianhydride and a monoamine derivative, both commercially available from Tokyo Chemical Industry or Sigma-Aldrich Japan. Derivatives having a structure represented by (A7) can be synthesized from a phenol derivative as a starting material, which is commercially available from Tokyo Chemical Industry or Sigma-Aldrich Japan. Derivatives having a structure represented by (A8) can be synthesized through the reaction between perylenetetracarboxylic dianhydride and a monoamine derivative, both commercially available from Tokyo Chemical Industry or Johnson Matthey Japan Incorporated. Derivatives having a structure represented by (A10) can be synthesized through the oxidation of a compound commercially available from Tokyo Chemical Industry or Sigma-Aldrich Japan with an appropriate oxidizing agent (e.g., potassium permanganate) in an organic solvent (e.g., chloroform). Derivatives having a structure represented by (A11) can be synthesized through the reaction between naphthalenetetracarboxylic dianhydride, a monoamine derivative, and hydrazine, all commercially available from Tokyo Chemical Industry or Sigma-Aldrich Japan. Derivatives having a structure represented by formula (A16) can be synthesized in any known method commonly used to synthesize a carboxylic imide.

A compound represented by any of (A1) to (A17) has a reactive functional group polymerizable with a cross-linking agent (a hydroxy group, a thiol group, an amino group, a carboxyl group, or a methoxy group). The polymerizable functional group can be introduced to the derivative having a structure represented by any of (A1) to (A17) in two methods. The first method is to introduce the reactive functional group directly to the derivative having a structure represented by any of (A1) to (A17). The second method is to introduce a structure having the reactive functional group or a structure having a functional group that can turn into a precursor of the reactive functional group. An example of the second method is to introduce an aryl group containing the functional group to a halide of the derivative having a structure represented by any of (A1) to (A17) through cross-coupling using, for instance, a palladium catalyst and a base. Another example is to introduce an alkyl group containing the functional group through cross-coupling using an $FeCl_3$ catalyst and a base. It is also possible to introduce a hydroxyalkyl or carboxyl group by allowing a lithiated compound to react with an epoxy compound or $CO_2$.

Cross-linking Agent

The following describes a cross-linking agent.

Examples of cross-linking agents that can be used include compounds that polymerize or form crosslinks with an electron transporting substance having a reactive functional group or with a thermoplastic resin having a reactive functional group (detailed hereinafter). Specific examples include compounds listed in "*Kakyouzai Handobukku*" (Cross-Linking Agents Handbook), Shinzo Yamashita and Tosuke Kaneko eds., Taiseisha Ltd. (1981) and other sources.

In an embodiment of the invention, the cross-linking agent can be an isocyanate compound. The isocyanate compound may have a molecular weight of 200 to 1300. The isocyanate compound may have two or more, preferably three to six, isocyanate or blocked isocyanate groups. Examples include triisocyanate benzene, triisocyanate methylbenzene, triphenylmethane triisocyanate, and lysine triisocyanate as well as isocyanurates, biurets, allophanates, adducts with trimethylolpropane or pentaerythritol, and other modified forms of diisocyanates such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanate hexanoate, and norbornane diisocyanate. In particular, isocyanurates and adducts are preferred.

The blocked isocyanate group is a group having a structure represented by —$NHCOX^1$ (where $X^1$ is a protecting group). The group $X^1$, which may be any protecting group that can be introduced to an isocyanate group, is preferably a group represented by any of formula (1) to (7).

[Chem. 5]

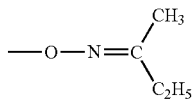

(1)

-continued
(2)
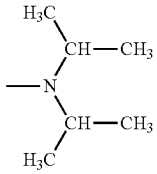
(3)
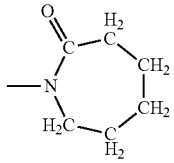
(4)
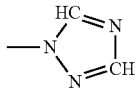
(5)
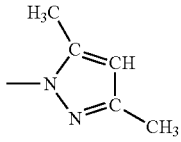
(6)
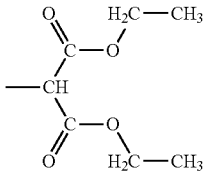
(7)
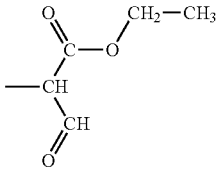
The following are some specific examples of isocyanate compounds.
[Chem. 6]
(B1)
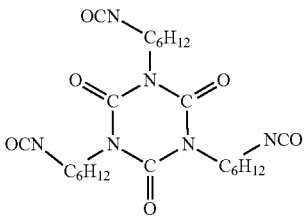
(B2)
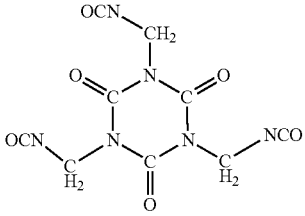
-continued
(B3)
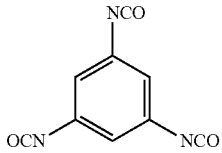
(B4)
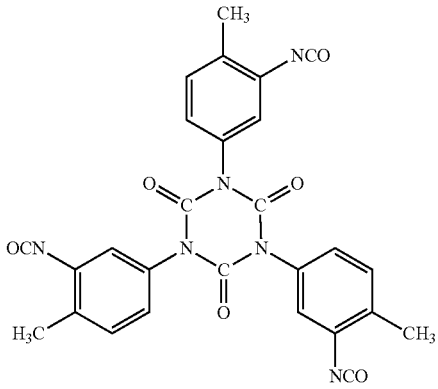
(B5)
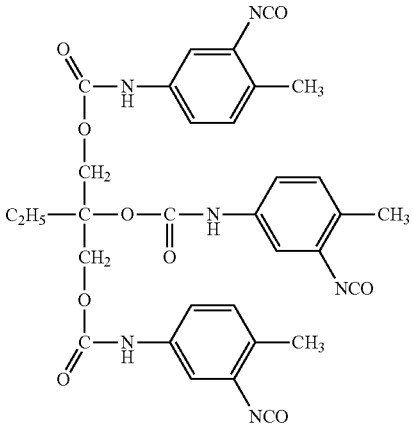
(B6)
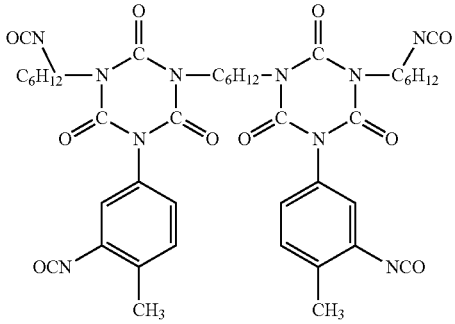
(B7)
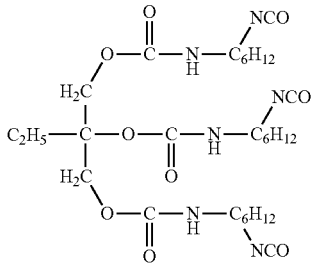

-continued (B8)

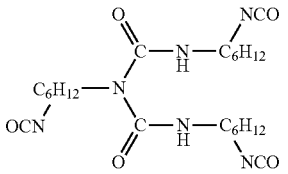

(B9)

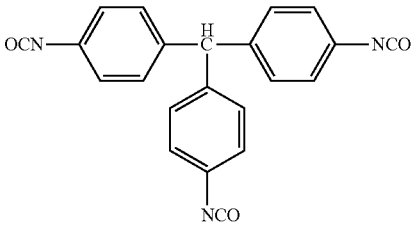

(B10)

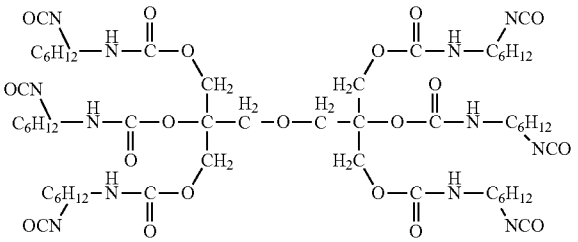

The following describes a thermoplastic resin having a reactive functional group (a polymerizable functional group). The thermoplastic resin having a reactive functional group can be a thermoplastic resin that has a structural unit represented by formula (D).

[Chem. 7]

(D)

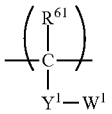

In formula (D), $R^{61}$ represents a hydrogen atom or an alkyl group, $Y^1$ represents a single bond, an alkylene group, or a phenylene group, and $W^1$ represents a hydroxy group, a thiol group, an amino group, a carboxyl group, and a methoxy group.

Examples of thermoplastic resins that have a structural unit represented by formula (D) include acetal resin, polyolefin resin, polyester resin, polyether resin, and polyamide resin. In addition to the structural unit represented by formula (D), these resins may have any of the characteristic structures represented by (E-1) to (E-5). Formula (E-1) represents a structural unit for acetal resin, (E-2) a structural unit for polyolefin resin, (E-3) a structural unit for polyester resin, (E-4) a structural unit for polyether resin, and (E-5) a structural unit for polyamide resin.

[Chem. 8]

(E-1)

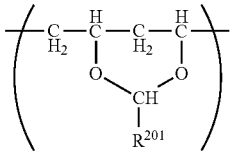

(E-2)

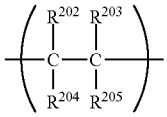

(E-3)

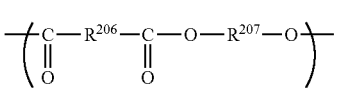

(E-4)

(E-5)

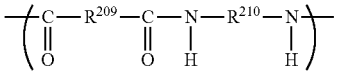

In formulae (E-1) to (E-5), $R^{201}$ to $R^{205}$ each independently represent a substituted or unsubstituted alkyl group or a substituted or unsubstituted aryl group, and $R^{206}$ to $R^{210}$ each independently represent a substituted or unsubstituted alkylene group or a substituted or unsubstituted arylene group. For example, when $R^{201}$ is $C_3H_7$, the resin is butyral.

Resin D can also be a commercially available product. Examples of commercially available resins include polyether polyol-based resins such as AQD-457 and AQD-473 (Nippon Polyurethane Industry) and SANNIX GP-400 and GP-700 (Sanyo Chemical Industries), polyester polyol-based resins such as PHTHALKYD W2343 (Hitachi Chemical), WATERSOL S-118 and CD-520 and BECKOLITE M-6402-50 and M-6201-40IM (DIC), HARIDIP WH-1188 (Harima Chemicals), and ES3604 and ES6538 (Japan U-Pica Co. Ltd.), polyacrylic polyol-based resins such as BURNOCK WE-300 and WE-304 (DIC), polyvinyl alcohol-based resins such as KURARAY POVAL PVA-203 (Kuraray), polyvinyl acetal-based resins such as BX-1 and BM-1 (Sekisui Chemical), polyamide-based resins such as TORESIN FS-350 (Nagase ChemteX), carboxyl-containing resins such as AQUALIC (Nippon Shokubai) and FINELEX SG2000 (Namariichi Co., Ltd.), polyamine resins such as LUCKAMIDE (DIC), and polythiol resins such as QE-340M (Toray Industries). In particular, resins like polyvinyl acetal-based resins and polyester polyol-based resins are preferred. The weight-average molecular weight (Mw) of resin D can be in the range of 5000 to 300000.

The amount by volume of the composite particles relative to the total amount by volume of the undercoat layer can be 0.2 times or more and 2.0 times or less the amount by volume of the electron transporting substance relative to the total amount by volume of the composition in the intermediate layer. In this range, charge streaks are improved. This improvement of charge streaks is presumably because enhanced polarization between the undercoat layer and the intermediate layer leads to increased dielectric relaxation in the electrophotographic photosensitive member, resulting in an increased potential difference in the lower charging area. These amounts by volume can be those measured at a temperature of 23° C. and a pressure of 1 atm.

Photosensitive Layer

A photosensitive layer is provided on the undercoat layer or an intermediate layer. The photosensitive layer can be a multilayer photosensitive layer having a charge generating layer and a charge transporting layer.

Examples of charge generating substances include azo pigments, phthalocyanine pigments, indigo pigments such as indigo and thioindigo, perylene pigments, polycyclic quinone pigments, squarylium dyes, pyrylium salts and thiapyrylium salts, triphenylmethane dyes, quinacridone pigments, azulenium salt pigments, cyanine dyes, xanthene dyes, quinone imine dyes, and styryl dyes. In particular, metal phthalocyanines such as oxytitanium phthalocyanine, hydroxygallium phthalocyanine, and chlorogallium phthalocyanine are preferred.

When the photosensitive layer is a multilayer photosensitive layer, the charge generating layer can be formed by applying a coating liquid obtained by dispersing a charge generating substance and a binder resin in a solvent (hereinafter a coating liquid for forming a charge generating layer) and then drying the resulting coat. Examples of dispersion methods include those based on the use of equipment such as a homogenizer, ultrasonic waves, a ball mill, a sand mill, an attritor, or a roll mill.

Examples of binder resins used in the charge generating layer include polycarbonate, polyesters, polyarylates, butyral resin, polystyrene, polyvinyl acetal, diallyl phthalate resin, acrylic resin, methacrylic resin, vinyl acetate resin, phenolic resin, silicone resin, polysulfone, styrene-butadiene copolymers, alkyd resin, epoxy resin, urea resin, and vinyl chloride-vinyl acetate copolymers. Any one of such resins can be used alone, and it is also possible to use a mixture or copolymer of two or more.

The mass proportion between the charge generating substance and the binder resin (charge generating substance: binder resin) can be in the range of 10:1 to 1:10, preferably 5:1 to 1:1, more preferably 3:1 to 1:1.

Examples of solvents used in the coating liquid for forming a charge generating layer include alcohols, sulfoxides, ketones, ethers, esters, halogenated aliphatic hydrocarbons, and aromatic compounds.

The thickness of the charge generating layer can be 0.1 μm or more and 5 μm or less, preferably 0.1 μm or more and 2 μm or less.

The charge generating layer may optionally contain additives such as various sensitizers, antioxidants, ultraviolet absorbers, and plasticizers. An electron transporting substance (an electron attracting substance, such as an acceptor) may also be added to the charge generating layer so as to help charge to flow in the charge generating layer.

When the photosensitive layer is a multilayer photosensitive layer, the charge transporting layer can be formed by applying a coating liquid obtained by dispersing a charge transporting substance and a binder resin in a solvent (hereinafter a coating liquid for forming a charge transporting layer) and then drying the resulting coat.

Minimizing the dielectric polarization in the charge transporting layer and thus preventing the dark decay in and after the lower charging area will lead to smaller changes in the amount of dark decay during repeated use. More specifically, the dielectric constant of the binder resin can be 3 or less. The charge mobility of the charge transporting substance can be $1\times10^{-6}$ cm/V·sec or less.

Specific examples of charge transporting substances include hydrazone compounds, styryl compounds, benzidine compound, triarylamine compounds, and triphenylamine compounds.

Specific examples of binder resins include acrylic resin, styrene resin, polyesters, polycarbonates, polyarylates, polysulfone, polyphenylene oxide, epoxy resin, polyurethane, and alkyd resin. In particular, polyesters, polycarbonates, and polyarylates are preferred. Any one of such resins can be used alone, and it is also possible to use a mixture or copolymer of two or more.

The mass proportion between the charge transporting substance and the binder resin (electron transporting substance:binder resin) can be in the range of 2:1 to 1:2.

Examples of solvents used in the coating liquid for forming a charge transporting layer include ketones such as acetone and methyl ethyl ketone, esters such as methyl acetate and ethyl acetate, ethers such as dimethoxymethane and dimethoxyethane, aromatic hydrocarbons such as toluene and xylene, and halogenated hydrocarbons such as chlorobenzene, chloroform, and carbon tetrachloride.

The thickness of the charge transporting layer can be 3 μm or more and 40 μm or less, preferably 5 μm or more and 30 μm or less.

The charge transporting layer may optionally contain an antioxidant, an ultraviolet absorber, and/or a plasticizer.

A protective layer may be provided on the photosensitive layer to protect the photosensitive layer.

The protective layer can be formed by applying a coating liquid containing a resin (binder resin) (hereinafter a coating liquid for forming a protective layer) to form a coat and then drying and/or curing the resulting coat.

Examples of binder resins used in the protective layer include phenolic resin, acrylic resin, polystyrene, polyesters, polycarbonates, polyarylates, polysulfone, polyphenylene oxide, epoxy resin, polyurethane, alkyd resin, and siloxane resin. Any one of such resins can be used alone, and it is also possible to use a mixture or copolymer of two or more.

The thickness of the protective layer can be 0.5 μm or more and 10 μm or less, preferably 1 μm or more and 8 μm or less.

The coating liquids for the individual layers can be applied using coating techniques such as dip coating, spray coating, spinner coating, roller coating, wire-bar coating, and blade coating.

Figure 1:
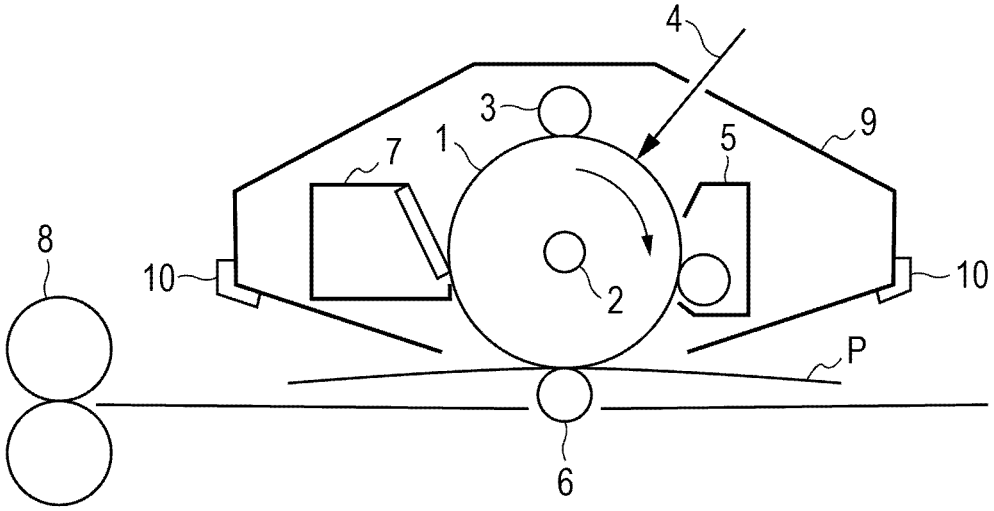
FIG. 1 is a diagram that illustrates an example of a schematic structure of an electrophotographic apparatus provided with a process cartridge having an electrophotographic photosensitive member according to an embodiment of the invention.

FIG. 1 illustrates an example of a schematic structure of an electrophotographic apparatus provided with a process cartridge having an electrophotographic photosensitive member.

In FIG. 1, the cylindrical electrophotographic photosensitive member 1 is driven to rotate around a shaft 2 at a given circumferential velocity in the direction indicated by an arrow.

The circumferential surface of the electrophotographic photosensitive member 1 driven to rotate is uniformly charged with a given positive or negative potential by a charging unit (e.g., a charging roller) 3 and then receives exposure light (image exposure light) 4 emitted from an exposure unit (a unit for image exposure, not illustrated). In this way, an electrostatic latent image that corresponds to the intended image is formed on the circumferential surface of the electrophotographic photosensitive member 1. The voltage applied to the charging unit 3 can be direct voltage alone or alternating voltage superimposed on direct voltage.

The electrostatic latent image formed on the circumferential surface of the electrophotographic photosensitive member 1 is developed using toner contained in a development unit 5 to form a toner image. The toner image formed on the circumferential surface of the electrophotographic photosensitive member 1 is then transferred to a transfer medium (e.g., paper) by a transfer unit (e.g., a transfer roller) 6. The transfer medium P is fed from a transfer medium supply unit (not illustrated) into the space between the electrophotographic photosensitive member 1 and the transfer unit 6 (the portion where they touch each other) in synchronization with the rotation of the electrophotographic photosensitive member 1.

The transfer medium P, carrying the transferred toner image, is separated from the circumferential surface of the electrophotographic photosensitive member 1 and guided to a fixing unit 8, where the image is fixed. As a result, an image-bearing article (a photographic print or copy) is printed out of the electrophotographic apparatus.

After the transfer of the toner image, the circumferential surface of the electrophotographic photosensitive member 1 is cleaned of any toner residue by a cleaning unit (e.g., a cleaning blade) 7, and then, after charge removal using pre-exposure light 11 emitted from a pre-exposure unit (not illustrated), is again used to form an image. When the charging unit 3 is a contact charging unit, pre-exposure may be unnecessary.

Two or more selected from these components including the electrophotographic photosensitive member 1, the charging unit 3, the development unit 5, and the cleaning unit 7 may be integrally held in a container to make up a process cartridge. This process cartridge may be attachable to and detachable from the main body of electrophotographic apparatus. In FIG. 1, the electrophotographic photosensitive member 1, the charging unit 3, the development unit 5, and the cleaning unit 7 are integrally held in a cartridge, making up a process cartridge 9 that can be attached to and detached from the main body of electrophotographic apparatus using a guiding unit 10 the main body of the electrophotographic apparatus has, such as rails.

A process cartridge and an electrophotographic apparatus according to certain embodiments of the invention may have a roller-shaped charging component (a charging roller) as a charging unit. The charging roller may be composed of, for example, a conductive base and one or more coating layers on the conductive base. At least one coating layer is conductive. An example of a more specific structure is a structure including a conductive base, a conductive elastic layer on the conductive base, and a surface layer on the conductive elastic layer.

The ten-point mean roughness (Rzjis) of the charging roller can be 5.0 μm or less. In certain embodiments of the invention, the ten-point mean roughness (Rzjis) of the charging roller is measured using a Kosaka Laboratory surface roughness measuring instrument (trade name: SE-3400).

An electrophotographic photosensitive member according to an embodiment of the invention becomes more effective in preventing charge streaks with reduced time for the upper discharging area,i.e., with increasing the rotational speed (cycle speed) of the electrophotographic apparatus equipped with the electrophotographic photosensitive member. More specifically, an embodiment of the invention is effective in preventing charge streaks at a cycle speed of 0.3 s/cycle or less, significantly effective at 0.2 s/cycle.

EXAMPLES

The following describes certain aspects of the invention in more detail by providing specific examples. No aspect of the invention is limited to these examples. The term "parts" in the following refers to "parts by mass."

Illustrative Production of Aluminum-doped Tin-oxide-coated Particles

The aluminum-doped tin-oxide-coated titanium oxide particles mentioned in the examples can be produced using the following method. The core of the composite particles, the dopant and its quantity, and the quantity of sodium stannate varied according to each example.

Two hundred grams of titanium oxide particles as core particles (average primary particle diameter: 200 nm) were dispersed in water. Then 208 g of sodium stannate ($Na_2SnO_3$; tin content, 41%) was dissolved to form mixed slurry. With this mixed slurry circulated, a dilute aqueous solution of sulfuric acid containing 20% sulfuric acid was added to the slurry so as to neutralize tin. The aqueous solution of dilute sulfuric acid was added until the pH of the mixed slurry was 2.5. After neutralization, the mixed slurry was stirred with aluminum chloride (8% by mole with respect to Sn). In this way, a precursor of the intended conductive particles was obtained. This precursor was made into a solid through washing in warm water and subsequent filtration for dehydration. The obtained solid was fired under reducing conditions, in an atmosphere of 2% by volume $H_2/N_2$ at 500° C., for 1 hour. In this way, the intended conductive particles were obtained. The mass proportion of aluminum as a dopant for tin oxide was 1.7% by mass.

The mass proportion (% by mass) of aluminum as a dopant for tin oxide to the tin oxide can be measured using a Spectris wavelength dispersive X-ray fluorescence spectrometer (trade name: Axios). The sample for measurement can be a piece of the undercoat layer of the electrophotographic photosensitive member obtained by removing the photosensitive layer and, if present, the intermediate layer and then chipping at the undercoat layer. The sample for measurement can also be a powder of the material of which the undercoat layer is made.

The mass proportion of aluminum as a dopant for tin oxide was calculated on the basis of the mass of alumina ($Al_2O_3$) versus the mass of tin oxide.

Example 1

The support was an aluminum cylinder (conductive support) having a diameter of 24 mm and a length of 261 mm.

In a sand mill containing 420 parts of 1.0-mm glass beads, the following materials were dispersed to form a dispersion liquid: 219 parts of aluminum-doped tin-oxide-coated titanium oxide particles (powder resistivity, $5.0\times10^7$ Ω·cm; tin oxide coverage, 35%; average primary particle diameter, 200 nm), 146 parts of phenolic resin as a binder resin (monomeric/oligomeric phenolic resin) (trade name, PLI-OPHEN J-325; DIC Corporation; solid resin content, 60%), and 106 parts of 1-methoxy-2-propanol as a solvent. The materials were dispersed under the following conditions: rotational speed, 2000 rpm; duration of dispersion, 4 hours;

cooling water temperature setting, 18° C. From this dispersion liquid, the glass beads were removed using a mesh screen. The obtained dispersion liquid was stirred with 23.7 parts of silicone resin particles as a surface roughening material (trade name, TOSPEARL 120; Momentive Performance Materials; average particle diameter, 2 μm), 0.024 parts of silicone oil as a leveling agent (trade name, SH28PA; Dow Corning Toray), 6 parts of methanol, and 6 parts of 1-methoxy-2-propanol to yield a coating liquid for forming an undercoat layer. This coating liquid for forming an undercoat layer was applied to the aforementioned support through dip coating to form a coat. The obtained coat was dried at 145° C. for 30 minutes, yielding an undercoat layer having a thickness of 30 μm.

Then a crystalline hydroxygallium phthalocyanine (a charge generating substance) having a crystal form that gave peaks at Bragg angles 2θ±0.2° of 7.4° and 28.1° in CuKα characteristic X-ray diffractometry was prepared. Four parts of this crystalline hydroxygallium phthalocyanine and 0.04 parts of the compound represented by formula (A) were added to a solution of 2 parts of polyvinyl butyral resin (trade name, S-LEC BX-1; Sekisui Chemical) in 100 parts of cyclohexanone. The obtained mixture was dispersed using sand mill equipment with 1-mm glass beads in an atmosphere at 23±3° C. for 1 hour. After dispersion, 100 parts of ethyl acetate was added to yield a coating liquid for forming a charge generating layer. This coating liquid for forming a charge generating layer was applied to the undercoat layer through dip coating to form a coat. The obtained coat was dried at 90° C. for 10 minutes, yielding a charge generating layer having a thickness of 0.20 μm.

[Chem. 9]

(A)

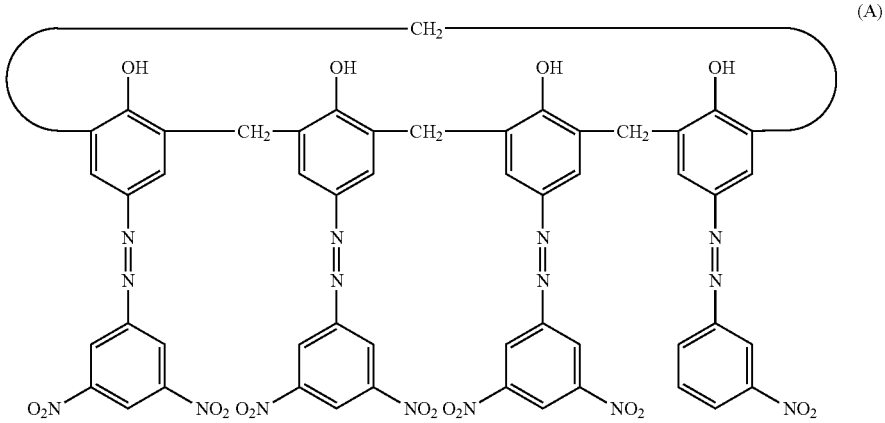

Then 50 parts of the amine compound represented by formula (B) (a charge transporting substance), 50 parts of the amine compound represented by formula (C) (a charge transporting substance), and 100 parts of polycarbonate resin (trade name, IUPILON Z400; Mitsubishi Gas Chemical) were dissolved in a solvent mixture of 650 parts of chlorobenzene and 150 parts of dimethoxymethane to yield a coating liquid for forming a charge transporting layer. This coating liquid for forming a charge transporting layer was stored for 1 day and then applied to the charge generating layer through dip coating to form a coat. The obtained coat was dried at 110° C. for 30 minutes, yielding a charge transporting layer having a thickness of 21 μm.

[Chem. 10]

(B)

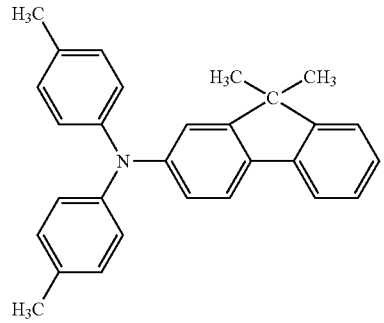

(C)

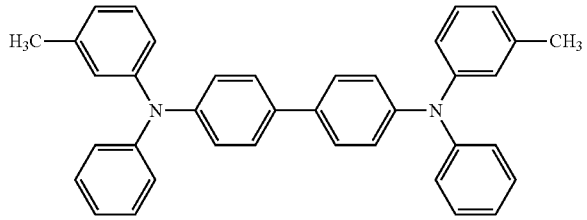

The following describes evaluation.

Evaluation of Changes in Light-field Potential During Repeated Use

The testing equipment was a Hewlett-Packard color laser-beam printer (trade name, CP4525; modified to allow variable process speeds). With the above-described electrophotographic photosensitive member fit to the drum cartridge of the testing equipment, the following evaluation was performed. The testing equipment was placed in a low-temperature and low-humidity (15° C. and 10% RH) environment.

The surface potential of the electrophotographic photosensitive member was measured using a surface potentiometer (model 344, Trek), with the potential probe (trade name, model 6000B-8; Trek) on the development cartridge removed from the testing equipment. The potentiometer was situated in such a manner that the potential probe should be in the portion of the development cartridge where the cartridge should perform image development. The position of the potential probe relative to the electrophotographic photosensitive member was such that the probe was in the middle of the photosensitive member in the axial direction with a gap of 3 mm from the surface of the photosensitive member. As for charging conditions, the applied bias voltage was adjusted to make the surface potential (dark-field potential) of the electrophotographic photosensitive member 600 V. The exposure conditions were adjusted so that the amount of exposure was 0.4 $\mu J/cm^2$.

The following describes evaluation. Each electrophotographic photosensitive member was evaluated under the initially specified charging and exposure conditions.

First, the electrophotographic photosensitive member is stored for 48 hours at a temperature of 15° C. and a humidity of 10% RH. Then a development cartridge fit with the electrophotographic photosensitive member was installed in the aforementioned testing equipment, and the photosensitive member was repeatedly used to process 15000 sheets of paper. The print coverage used for the processing of 15000 sheets was 4%. The cycle of outputting two sheets and stopping the operation was repeated until 15000 sheets of paper were processed. The process speed during the repeated used was such that the electrophotographic photosensitive member was at 0.3 s/cycle.

After 15000 sheets of paper were processed, a black-and-white halftone was output using the cartridge in the black station. The black-and-white halftone was output at the process speeds where the electrophotographic photosensitive member rotated at three velocities, 0.5 s/cycle, 0.3 s/cycle, and 0.2 s/cycle. The criteria for the evaluation of the image are as follows.

Evaluation of Horizontal Charge Streaks

A: No charge streaks.

B: A few charge streaks observed at the edge of the image.

D: Charge streaks observed.

E: Easily noticeable charge streaks.

Example 2

The polycarbonate resin for the charge transporting layer used in Example 1 was changed to a polyester resin containing the structural unit represented by formula (16-1) and the structural unit represented by formula (16-2) in a ratio of 5/5 and having a weight-average molecular weight (Mw) of 100000. Except for this, the same procedure as in Example 1 was followed to produce an electrophotographic photosensitive member.

[Chem. 11]

(16-1)

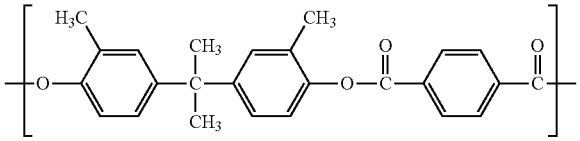

(16-2)

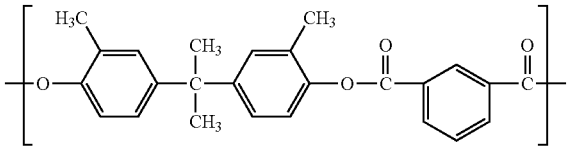

Example 3

A protective layer was formed on the charge transporting layer in Example 1 as follows. Except for this, the same procedure as in Example 1 was followed to produce an electrophotographic photosensitive member.

A mixture of 36 parts of compound (D), which is represented by the formula below, 4 parts of polytetrafluoroethylene resin particles (trade name, LUBRON L-2; Daikin Industries), and 60 parts of n-propyl alcohol was dispersed in an ultrahigh-pressure dispersing machine to yield a coating liquid for forming a protective layer.

[Chem. 12]

(D)

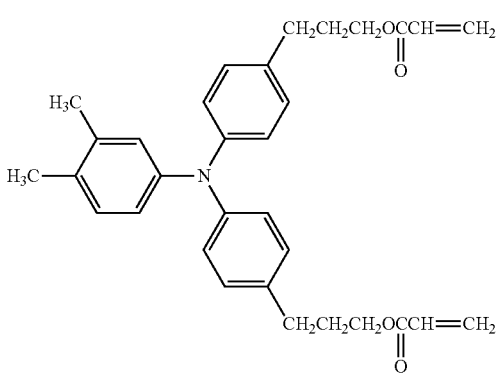

This coating liquid for forming a protective layer was applied to the charge transporting layer through dip coating to form a coat, and the obtained coat was dried at 50° C. for 5 minutes. After drying, the coat was irradiated with an electron beam at an acceleration voltage of 70 kV and an absorbed dose of 8000 Gy for 1.6 seconds in a nitrogen atmosphere, with the support rotated. Then the coat was heated for 3 minutes in a nitrogen atmosphere under such conditions that its temperature would be 130° C. During the period from the irradiation with an electron beam to the 3-minute heating, the oxygen concentration was 20 ppm. The coat was then heated for 30 minutes in the air under such conditions that its temperature would be 100° C., yielding a protective layer (a second charge transporting layer) having a thickness of 5 μm.

Example 4

An intermediate layer was formed on the undercoat layer in Example 1 as follows. Except for this, the same procedure as in Example 1 was followed to produce an electrophotographic photosensitive member.

Four point five parts of N-methoxymethylated nylon (trade name, TORESIN EF-30T; Nagase ChemteX) and 1.5 parts of a copolymeric nylon resin (trade name, AMILAN CM8000; Toray Industries) were dissolved in a solvent mixture of 65 parts of methanol and 30 parts of n-butanol to yield a coating liquid for forming an intermediate layer. This coating liquid for forming an intermediate layer was applied to the undercoat layer through dip coating to form a coat. The obtained coat was dried at 70° C. for 6 minutes, yielding an intermediate layer having a thickness of 0.65 μm.

Example 5

An intermediate layer was formed on the undercoat layer in Example 1 as follows. Except for this, the same procedure as in Example 1 was followed to produce an electrophotographic photosensitive member.

Eight parts of illustrative compound A101, 10 parts of an isocyanate compound (B1) blocked with the group represented by formula (1), 0.1 parts of zinc (II) octylate, and 2 parts of butyral resin (KS-5, Sekisui Chemical) were dissolved in a solvent mixture of 100 parts of dimethylacetamide and 100 parts of methyl ethyl ketone to yield a coating liquid for forming an intermediate layer. This coating liquid for forming an intermediate layer was applied to the undercoat layer through dip coating to form a coat. The obtained coat was heated at 160° C. for 30 minutes to cure (polymerize), yielding an intermediate layer having a thickness of 0.5 μm.

The specific gravity of the aluminum-doped tin-oxide-coated titanium oxide used in Example 5 is 5.1 g/cm$^3$. As for the other materials used in the undercoat layer, the specific gravity is 1.0 g/cm$^3$. The amount by volume of the conductive particles relative to the total amount by volume of the undercoat layer is 33% by volume. In the intermediate layer used in Example 5, all materials have a specific gravity of 1.0 g/cm$^3$. The amount by volume of the electron transporting substance relative to the total amount by volume of the composition in the intermediate layer is therefore 40% by volume.

The amount by volume of the conductive particles relative to the total amount by volume of the undercoat layer is therefore 0.83 times the amount by volume of the electron transporting substance relative to the total amount by volume of the composition in the intermediate layer.

Example 6

In the undercoat layer in Example 5, the core particles of the aluminum-doped tin-oxide-coated titanium oxide particles were changed from titanium oxide particles to barium sulfate particles. Except for this, the same procedure as in Example 5 was followed to form an undercoat layer and produce an electrophotographic photosensitive member. The specific gravity of the aluminum-doped tin-oxide-coated barium sulfate particles used in Example 6 is 5.3 g/cm$^3$.

Example 7

In the undercoat layer in Example 5, the core particles of the aluminum-doped tin-oxide-coated titanium oxide particles were changed from titanium oxide particles to zinc oxide particles. Except for this, the same procedure as in Example 5 was followed to form an undercoat layer and produce an electrophotographic photosensitive member. The specific gravity of the aluminum-doped tin-oxide-coated zinc oxide particles used in Example 7 is 6.1 g/cm$^3$.

Example 8

In the undercoat layer in Example 5, the core particles of the aluminum-doped tin-oxide-coated titanium oxide particles were changed from titanium oxide particles to aluminum oxide particles. Except for this, the same procedure as in Example 5 was followed to form an undercoat layer and produce an electrophotographic photosensitive member.

Example 9

In the undercoat layer in Example 5, the mass proportion of aluminum as a dopant for tin oxide in the aluminum-doped tin-oxide-coated titanium oxide particles was changed to 0.25% by mass. Except for this, the same procedure as in Example 5 was followed to form an undercoat layer and produce an electrophotographic photosensitive member. The powder resistivity of these aluminum-doped tin-oxide-coated titanium oxide particles was $1.0\times10^4$ Ω·cm.

Example 10

In the undercoat layer in Example 5, the mass proportion of aluminum as a dopant for tin oxide in the aluminum-doped tin-oxide-coated titanium oxide particles was changed to 2% by mass. Except for this, the same procedure as in Example 5 was followed to form an undercoat layer and produce an electrophotographic photosensitive member. The powder resistivity of these aluminum-doped tin-oxide-coated titanium oxide particles was $1.0\times10^8$ Ω·cm.

Example 11

In the undercoat layer in Example 5, the mass proportion of aluminum as a dopant for tin oxide in the aluminum-doped tin-oxide-coated titanium oxide particles was changed to 3% by mass. Except for this, the same procedure as in Example 5 was followed to form an undercoat layer and produce an electrophotographic photosensitive member. The powder resistivity of these aluminum-doped tin-oxide-coated titanium oxide particles was $1.0\times10^{10}$ Ω·cm.

Example 12

In the undercoat layer in Example 5, the amount of the aluminum-doped tin-oxide-coated titanium oxide particles was changed from 218 parts to 44 parts. Except for this, the same procedure as in Example 5 was followed to form an undercoat layer and produce an electrophotographic photosensitive member.

Example 13

In the undercoat layer in Example 5, the amount of the aluminum-doped tin-oxide-coated titanium oxide particles was changed from 218 parts to 174 parts. Except for this, the same procedure as in Example 5 was followed to form an undercoat layer and produce an electrophotographic photosensitive member.

Example 14

In the undercoat layer in Example 5, the amount of the aluminum-doped tin-oxide-coated titanium oxide particles was changed from 218 parts to 436 parts. Except for this, the same procedure as in Example 5 was followed to form an undercoat layer and produce an electrophotographic photosensitive member.

Example 15

In the undercoat layer in Example 5, the mass proportion of tin oxide to the aluminum-doped tin-oxide-coated titanium oxide particles was changed from 30% by mass to 5% by mass. Except for this, the same procedure as in Example 5 was followed to form an undercoat layer and produce an electrophotographic photosensitive member.

Example 16

In the undercoat layer in Example 5, the mass proportion of tin oxide to the aluminum-doped tin-oxide-coated titanium oxide particles was changed from 30% by mass to 10% by mass. Except for this, the same procedure as in Example 5 was followed to form an undercoat layer and produce an electrophotographic photosensitive member.

Example 17

In the undercoat layer in Example 5, the mass proportion of tin oxide to the aluminum-doped tin-oxide-coated titanium oxide particles was changed from 30% by mass to 60% by mass. Except for this, the same procedure as in Example 5 was followed to form an undercoat layer and produce an electrophotographic photosensitive member.

Example 18

In the undercoat layer in Example 5, the mass proportion of tin oxide to the aluminum-doped tin-oxide-coated titanium oxide particles was changed from 30% by mass to 65% by mass. Except for this, the same procedure as in Example 5 was followed to form an undercoat layer and produce an electrophotographic photosensitive member.

Example 19

The thickness of the undercoat layer in Example 5 was changed to 15 μm. Except for this, the same procedure as in Example 5 was followed to form an undercoat layer and produce an electrophotographic photosensitive member.

Example 20

The thickness of the undercoat layer in Example 5 was changed to 40 μm. Except for this, the same procedure as in Example 5 was followed to form an undercoat layer and produce an electrophotographic photosensitive member.

Example 21

In the intermediate layer in Example 5, illustrative compound A101 was changed to the electron transporting substance represented by the formula below. Except for this, the same procedure as in Example 5 was followed to form an intermediate layer and produce an electrophotographic photosensitive member.

[Chem. 13]

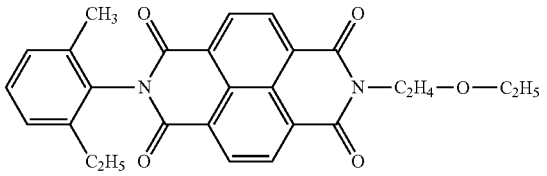

The amount by volume of the conductive particles relative to the total amount by volume of the undercoat layer is 33% by volume. In the intermediate layer used in Example 21, all materials have a specific gravity of 1.0 g/cm$^3$. The amount by volume of the electron transporting substance relative to the total amount by volume of the composition in the intermediate layer is therefore 40% by volume.

The amount by volume of the conductive particles relative to the total amount by volume of the undercoat layer is therefore 0.83 times the amount by volume of the electron transporting substance relative to the total amount by volume of the composition in the intermediate layer.

Example 22

An intermediate layer was formed on the undercoat layer in Example 1 as follows. Except for this, the same procedure as in Example 1 was followed to produce an electrophotographic photosensitive member.

Eight point five parts of the electron transporting substance represented by the formula below, 15 parts of a blocked isocyanate compound (trade name, SBN-70D; Asahi Kasei Chemicals), 0.97 parts of polyvinyl alcohol-acetal resin (trade name, KS-5Z; Sekisui Chemical), and 0.15 parts of zinc (II) hexanoate (trade name, Zinc (II) Hexanoate; Mitsuwa Chemicals) were dissolved in a solvent mixture of 88 parts of 1-methoxy-2-propanol and 88 parts of tetrahydrofuran to yield a coating liquid for forming an intermediate layer.

This coating liquid for forming an intermediate layer was applied to the undercoat layer in Example 1 through dip coating to form a coat. The obtained coat was heated at 170° C. for 20 minutes to cure (polymerize), yielding an intermediate layer having a thickness of 0.6 μm.

[Chem. 14]

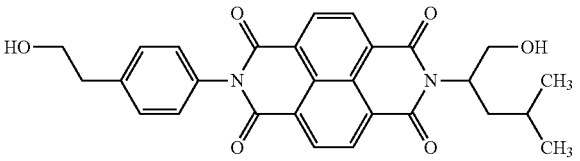

In the intermediate layer used in Example 22, all materials have a specific gravity of 1.0 g/cm$^3$. The amount by volume of the electron transporting substance relative to the total amount by volume of the composition in the intermediate layer is therefore 40% by volume. The amount by volume of the conductive particles relative to the total amount by volume of the undercoat layer is therefore 0.83 times the amount by volume of the electron transporting substance relative to the total amount by volume of the composition in the intermediate layer.

Example 23

The undercoat layer in Example 1 was formed with the following modifications. Except for this, the same procedure as in Example 1 was followed to produce an electrophotographic photosensitive member.

In a sand mill containing 420 parts of 1.0-mm glass beads, the following materials were dispersed to form a dispersion liquid: 219 parts of aluminum-doped tin-oxide-coated titanium oxide particles (powder resistivity, $5.0\times10^7$ Ω·cm; tin oxide coverage, 35%; average primary particle diameter, 200 nm), 15 parts of aluminum-doped tin oxide particles (powder resistivity: $5.0\times10^7$ Ω·cm), 146 parts of phenolic resin as a binder resin (monomeric/oligomeric phenolic resin) (trade name, PLI-O-PHEN J-325; DIC Corporation; solid resin content, 60%), and 106 parts of 1-methoxy-2-propanol as a solvent. The materials were dispersed under the following conditions: rotational speed, 2000 rpm; duration of dispersion, 4 hours; cooling water temperature setting, 18° C. From this dispersion liquid, the glass beads were removed using a mesh screen. The obtained dispersion liquid was stirred with 23.7 parts of silicone resin particles as a surface roughening material (trade name, TOSPEARL 120; Momentive Performance Materials; average particle diameter, 2 μm), 0.024 parts of silicone oil as a leveling agent (trade name, SH28PA; Dow Corning Toray), 6 parts of methanol, and 6 parts of 1-methoxy-2-propanol to yield a coating liquid for forming an undercoat layer. This coating liquid for forming an undercoat layer was applied to the aforementioned support through dip coating to form a coat. The obtained coat was dried at 145° C. for 30 minutes, yielding an undercoat layer having a thickness of 30 μm.

As mentioned above, the volume ratio between the aluminum-doped tin oxide particles and the aluminum-doped tin-oxide-coated particles can be determined through a Slice & View observation with FIB-SEM. The determined volume ratio between the aluminum-doped tin oxide particles and the aluminum-doped tin-oxide-coated particles is 50/1000.

Example 24

The same procedure as in Example 23 was followed to produce an electrophotographic photosensitive member, except that in Example 23, the amount of the aluminum-doped tin oxide particles was changed from 15 parts to 0.3 parts.

As a result, the volume ratio between the aluminum-doped tin oxide particles and the aluminum-doped tin-oxide-coated particles is 1/1000.

Example 25

The same procedure as in Example 23 was followed to produce an electrophotographic photosensitive member, except that in Example 23, the amount of the aluminum-doped tin-oxide-coated titanium oxide particles was changed from 219 parts to 170 parts, and the amount of the aluminum-doped tin oxide particles was changed from 15 parts to 50 parts.

As a result, the volume ratio between the aluminum-doped tin oxide particles and the aluminum-doped tin-oxide-coated particles is 200/1000.

Comparative Example 1

In the undercoat layer in Example 1, the aluminum-doped tin-oxide-coated titanium oxide particles were changed to phosphorus-doped tin-oxide-coated titanium oxide particles. Except for this, the same procedure as in Example 1 was followed to form an undercoat layer and produce an electrophotographic photosensitive member.

Comparative Example 2

In the undercoat layer in Example 1, the aluminum-doped tin-oxide-coated titanium oxide particles were changed to tungsten-doped tin-oxide-coated titanium oxide particles. Except for this, the same procedure as in Example 1 was followed to form an undercoat layer and produce an electrophotographic photosensitive member.

Comparative Example 3

In the undercoat layer in Example 1, the aluminum-doped tin-oxide-coated titanium oxide particles were changed to antimony-doped tin-oxide-coated titanium oxide particles. Except for this, the same procedure as in Example 1 was followed to form an undercoat layer and produce an electrophotographic photosensitive member.

Comparative Example 4

In Comparative Example 3, the intermediate layer used in Example 21 was provided between the undercoat layer and the charge generating layer. Except for this, the same procedure as in Comparative Example 3 was followed to form an undercoat layer and produce an electrophotographic photosensitive member.

Comparative Example 5

In Example 1, the undercoat layer was formed with the following modifications. Except for this, the same procedure as in Example 1 was followed to form an undercoat layer and produce an electrophotographic photosensitive member.

First, a polyolefin resin was produced as follows.

Preparation of a Dispersion Liquid Containing Polyolefin Resin Particles

A mixer fit with a hermetic and pressure-resistant 1-L glass container having a heater was used to stir 75.0 g of polyolefin resin (BONDINE HX-8290, Sumitomo Chemical), 60.0 g of isopropanol, 5.1 g of triethylamine (TEA), and 159.9 g of distilled water charged in the glass container, with the stirring blades rotated at 300 rpm. Particulate resin was found floating in the container, rather than settling on the bottom. This state was maintained for 10 minutes, and the heater was turned on to heat. The mixture was stirred for another 20 minutes with the temperature in the system kept in the range from 140° C. to 145° C. The mixture was then cooled in a water bath to room temperature (approximately 25° C.) while being stirred at a rotational speed of 300 rpm. The cooled mixture was filtered through a 300-mesh stainless steel filter (wire diameter, 0.035 mm; plain-woven) under pressure (air pressure: 0.2 MPa), yielding an opaque, uniform aqueous dispersion of polyolefin resin.

Ten parts of antimony-doped tin oxide particles (trade name, T-1; Mitsubishi Materials) and 90 parts of isopropanol (IPA) were dispersed using a ball mill for 72 hours to yield a tin oxide dispersion liquid. This tin oxide dispersion liquid was mixed with the dispersion liquid containing polyolefin resin particles in a proportion of 4.2 parts of tin oxide to 1 part of solid polyolefin resin. The solvents were then added to make the solvent proportion 8/2 (water/IPA) and the solid content of the resulting dispersion liquid 2.5% by mass. The obtained mixture was stirred to yield a coating solution for forming an undercoat layer.

This coating liquid for forming an undercoat layer was applied to the support through dip coating to form a coat. The obtained coat was dried at 100° C. for 30 minutes, yielding an undercoat layer having a thickness of 30 μm.

TABLE 18

| Example/Comparative | Process speed | | |
|---|---|---|---|
| Example | 0.5 s/cycle | 0.3 s/cycle | 0.2 s/cycle |
| Example 1 | B | A | A |
| Example 2 | B | A | A |
| Example 3 | B | A | A |
| Example 4 | B | B | A |
| Example 5 | A | A | A |
| Example 6 | B | A | A |
| Example 7 | B | A | A |
| Example 8 | B | B | B |
| Example 9 | B | B | B |

TABLE 18-continued

| Example/Comparative Example | Process speed 0.5 s/cycle | 0.3 s/cycle | 0.2 s/cycle |
|---|---|---|---|
| Example 10 | A | A | A |
| Example 11 | B | A | A |
| Example 12 | B | B | A |
| Example 13 | A | A | A |
| Example 14 | B | B | B |
| Example 15 | B | A | A |
| Example 16 | B | A | A |
| Example 17 | A | A | B |
| Example 18 | B | B | B |
| Example 19 | A | A | B |
| Example 20 | B | A | A |
| Example 21 | A | A | B |
| Example 22 | A | A | A |
| Example 23 | A | A | A |
| Example 24 | A | A | A |
| Example 25 | A | A | A |
| Comparative Example 1 | D | D | E |
| Comparative Example 2 | B | D | E |
| Comparative Example 3 | B | E | E |
| Comparative Example 4 | B | D | E |
| Comparative Example 5 | D | E | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

The invention claimed is:

1. An electrophotographic photosensitive member comprising:

a support;

an undercoat layer on the support; and a photosensitive layer on the undercoat layer;

wherein the undercoat layer comprises:

a binder resin; and conductive particles each comprising a core particle coated with tin oxide doped with aluminum.

2. The electrophotographic photosensitive member according to claim 1, wherein the core particle is a zinc oxide particle, a titanium oxide particle, or a barium sulfate particle.

3. The electrophotographic photosensitive member according to claim 1, wherein a content of the tin oxide to the conductive particles is 10% by mass or more and 60% by mass or less.

4. The electrophotographic photosensitive member according to claim 1, wherein a mass ratio between the conductive particles coated with tin oxide doped with aluminum and the binder resin is 1/1 or more and 4/1 or less.

5. The electrophotographic photosensitive member according to claim 1, wherein the undercoat layer further comprises particles of tin oxide doped with aluminum.

6. The electrophotographic photosensitive member according to claim 5, wherein a volume ratio between the particles of tin oxide doped with aluminum and the conductive particles is 1/1000 or more and 250/1000 or less.

7. The electrophotographic photosensitive member according to claim 1, wherein the binder resin is polyurethane resin or phenolic resin.

8. The electrophotographic photosensitive member according to claim 1, wherein the electrophotographic photosensitive member further comprises an intermediate layer between the undercoat layer and the photosensitive layer, and the intermediate layer comprises a polymerized product of a composition comprising an electron transporting substance having a reactive functional group.

9. The electrophotographic photosensitive member according to claim 8, wherein the polymerized product is a polymerized product of a composition comprising the electron transporting substance, a cross-linking agent, and a resin having a reactive functional group.

10. The electrophotographic photosensitive member according to claim 8, wherein an amount by volume of the conductive particles relative to a total amount by volume of the undercoat layer is 0.2 times or more and 2.0 times or less an amount by volume of the electron transporting substance relative to a total amount by volume of the composition in the intermediate layer.

11. A process cartridge comprising the electrophotographic photosensitive member according to claim 1 and at least one unit selected from the group consisting of a charging unit, a development unit, and a cleaning unit, the process cartridge integrally holding the electrophotographic photosensitive member and the unit, wherein the process cartridge is attachable to and detachable from a main body of an electrophotographic apparatus.

12. An electrophotographic apparatus comprising the electrophotographic photosensitive member according to claim 1, a charging unit, an exposure unit, a development unit, and a transfer unit.

* * * * *